United States Patent [19]

Tabler et al.

[11] Patent Number: 4,936,458

[45] Date of Patent: Jun. 26, 1990

[54] BAKERY TRAY WITH BLEND STACKING

[75] Inventors: Charles P. Tabler, Hamilton; Eric D. Stein, Batavia, both of Ohio

[73] Assignee: Buckhorn, Inc., Milford, Ohio

[21] Appl. No.: 274,500

[22] Filed: Nov. 21, 1988

[51] Int. Cl.[5] ..... B65D 21/04

[52] U.S. Cl. ..... 206/507; 206/386; 220/66

[58] Field of Search ..... 206/386, 501, 503, 505, 206/507, 514, 595; 220/66, 69; 70

[56] References Cited

U.S. PATENT DOCUMENTS

| | | | |
|---|---|---|---|
| 3,219,232 | 11/1965 | Wilson . | |
| 3,392,875 | 7/1968 | Bockenstette . | |
| 3,819,044 | 6/1974 | Bockenstette . | |
| 3,825,114 | 7/1974 | Johnson et al. . | |
| 3,865,239 | 2/1975 | Herolzer | 206/507 |
| 3,934,724 | 1/1976 | Johnson . | |
| 3,951,265 | 4/1976 | Carroll . | |
| 4,000,817 | 1/1977 | Sanders et al. . | |
| 4,023,680 | 5/1977 | Thurman . | |
| 4,042,127 | 8/1977 | Brossia | 206/386 |
| 4,106,625 | 8/1978 | Carroll | 206/501 |
| 4,426,001 | 1/1984 | Stahl et al. . | |
| 4,520,928 | 6/1985 | Wilson . | |
| 4,523,681 | 1/1985 | Kreeger | 206/507 |
| 4,588,087 | 5/1986 | Swirgley | 220/66 |
| 4,750,633 | 6/1988 | Schafer | 220/70 |
| 4,775,050 | 10/1988 | Box | 206/507 |

FOREIGN PATENT DOCUMENTS

| | | | |
|---|---|---|---|
| 603612 | 4/1978 | U.S.S.R. | 206/386 |

OTHER PUBLICATIONS

Product brochure, Phillips Products Co., Inc., Bakester Blind Stacker Trays (not dated).

*Primary Examiner*—George E. Lowrance

*Attorney, Agent, or Firm*—Fay, Sharpe, Beall, Fagan, Minnich & McKee

[57] ABSTRACT

A unitary molded plastic bakery tray, with the end walls higher than the side walls to provide for a 90 degree cross-nesting, and the end walls having interengaging feet and rails to provide for 180 degree oriented high stacking and like oriented low stacking. The bottom is either a flat planar surface with chamfered bottom edges or is raised so that the tray is provided with corner structure having chamfered bottom edges. Blind stacking structure is provided by an additional outer rail on each end wall and additional outer feed on each end wall for engaging the outer rail. Alternatively, blind stacking is provided by structure along each end wall having large feet and cooperating large recesses coplanar with inner small feet and cooperating inner recesses such that the large feet can span and smoothly slide over the small recesses during blind stacking. Further, trays of different series having different stacking heights can be blind stacked on one another during stacking, but include bottom and side wall structure that prevents inter cross-nesting of trays of different series.

24 Claims, 21 Drawing Sheets

BAKERY TRAY WITH BLEND STACKING

BACKGROUND OF THE INVENTION

The present invention relates to bakery trays that are generally rectangular with high end walls, lower side walls, and a bottom so that they may be cross-nested at a 90 degree orientation. The trays are further provided with interengaging feet and rails so that they may be stacked at high and low positions with 180 degree orientation and like orientation.

These trays are moved about singularly and in stacks by sliding across floors and other surfaces, and by movement along conveyors, such as roller or wheeled conveyors. The trays are also manually handled, for example by being stacked in various orientations in large stacks at different locations, including within a truck. Such stacks sometimes reach a height greater than the height of the person doing the stacking, at which time the stacking of the next highest tray is done overhead and termed blind stacking. During blind stacking, it is very common to have various portions of the trays hang up by interfering engagement to provide excess forces or to stop the sliding. Such stopping or excess forces can become quite annoying to the operators, produce forces that would topple a stack of trays, and generally increase handling time.

These trays are used in great volume by large bakeries, distributors and retailers, so that small differences tend to take on large proportions when multiplied by the volume of trays in use. For example, a small annoyance or small delay in blind stacking becomes very large when repeated thousands of times, where there are tens or hundreds of thousands of trays within one distribution system.

SUMMARY OF THE INVENTION

It is an object of the present invention to provide bakery trays having interengaging structure that permits blind stacking of one tray on another.

It is a further object of the present invention to improve the handling of bakery trays, wherein the bottom surface of the baking tray is involved.

It is another object of the invention to increase the number of products that can be handled within one tray system by providing more than one series of trays within the system, wherein each series of trays can be interstacked with one another during use of the trays in transporting goods, but prevented from inter cross nesting with one another during return of the trays.

It is another object of the invention to increase the number of products that can be handled with one bakery tray system by providing more than one series of unitary molded plastic construction, with end walls and side walls to provide for 90 degree cross-nesting. The end walls of a first series of trays have interengaging feet and rails to provide for 180 degree oriented high stacking and like oriented low stacking. Another series of trays has interengaging feet and rails for either 180 degree oriented or like oriented stacking that is of the same height. The trays of the first and second series are interstackable. Accordingly, high and low stacking of one series of trays allows for the transporting of goods of two different product heights while interstacking of the first series of trays with another series of trays allows the transporting of additional goods of different product height.

Blind stacking of the trays of either series is provided by an additional outer rail at the upper end of each end wall of the tray and laterally extending outer feet at the bottom of each end wall for engaging the outer rail. Alternatively, interengaging structure is provided that includes a channel formed between an outer stacking rail and a guide rail at the upper end of each end wall and a plurality of feet along the lower part of the end wall that allows sliding engagement of the feet within the channel. Further, in one series of trays, the plurality of feet can be divided between outwardly spaced large feet and inwardly spaced small feet and cooperating outer and inner recesses that are sized to receive the large and small feet. The large and small recesses are aligned with the large and small feet in like orientation to provide low stacking of the series of trays. In 180 degree orientation, the feet and recesses are out of alignment so that the feet of an upper tray are stacked onto the channel of a lower tray to provide high stacking.

After transporting of the goods with the trays, cross-nesting is permitted by changing the orientation between upper and lower like series of trays by 90 degrees. Further, side wall-bottom wall interengaging structure is provided that prevents cross-nesting between trays of different series, even though trays of different series may be interstacked with one another by providing the appropriate end wall foot and recess structure.

According to one embodiment of the invention, it is an object of the invention to provide generally flat planar bottom surfaces of the trays that include chamfered or beveled edges. According to another embodiment of the invention, it is an object to provide stacking corner structure at the bottom of the trays and corresponding raised bottom wall construction that spaces the bottom wall of the trays off of the planar surface on which they are supported and provides rigidity at the corners of the tray to allow for stacking the trays in large numbers.

BRIEF DESCRIPTION OF THE DRAWINGS

Further objects, features and advantages of the present invention will become more clear from the following detailed description of the preferred embodiments, shown in the drawings, wherein.

DETAILED DESCRIPTION OF THE PREFERRED EMBODIMENTS

FIGS. 1–19 show preferred embodiments of the invention. wherein two different height trays may be stacked with themselves or interstacked, with the first size tray of a first embodiment being shown in FIGS. 1, 2, 4 and 7–15, and the smaller size tray of a second embodiment being shown in FIGS. 3, 5, 6 and 25. A third embodiment of the present invention is shown in FIGS. 20–24. A fourth embodiment of the present invention is shown in FIGS. 26–29. With respect to all the embodiments, like numerals have been provided for like parts wherein the descriptions herein are identical, with primes being added to show different tray constructions otherwise.

The unitary molded plastic tray of the present invention is used, for example, for storing and transporting bakery goods and the like. It is common for bakery trays to be nestable and stackable in different levels, for conserving space in transporting and storing bakery goods of different height.

Figure 1:
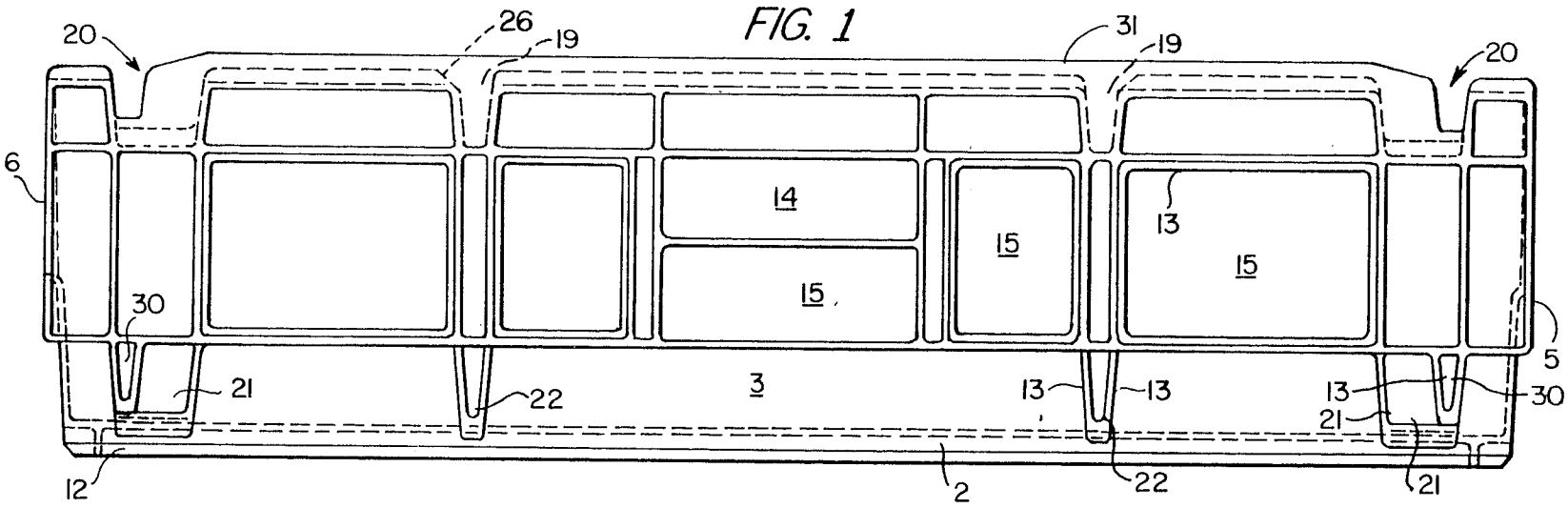
FIG. 1 is an elevational end wall view of a tray constructed according to a first embodiment of the present invention.
Figure 2:
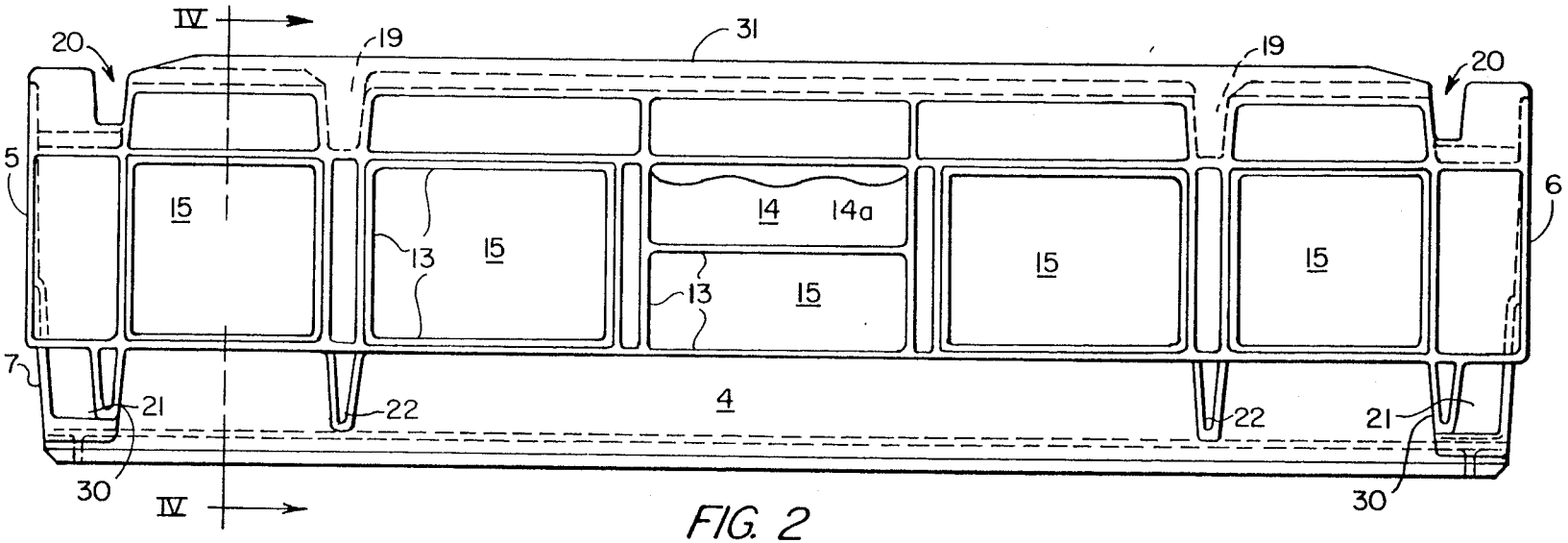
FIG. 2 is an elevational view of the opposite end wall of the tray according to FIG. 1.
Figure 6:
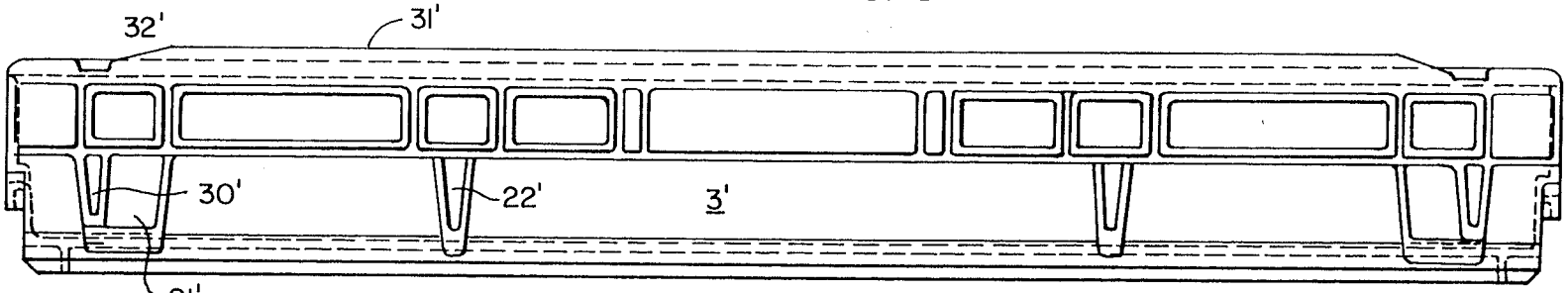
FIG. 6 is an elevational view of the opposite end wall of the tray according to FIG. 5, with the elevational side views of this tray being substantially the same, but of reduced size as that shown in FIG. 4 for the side walls.
Figure 4:
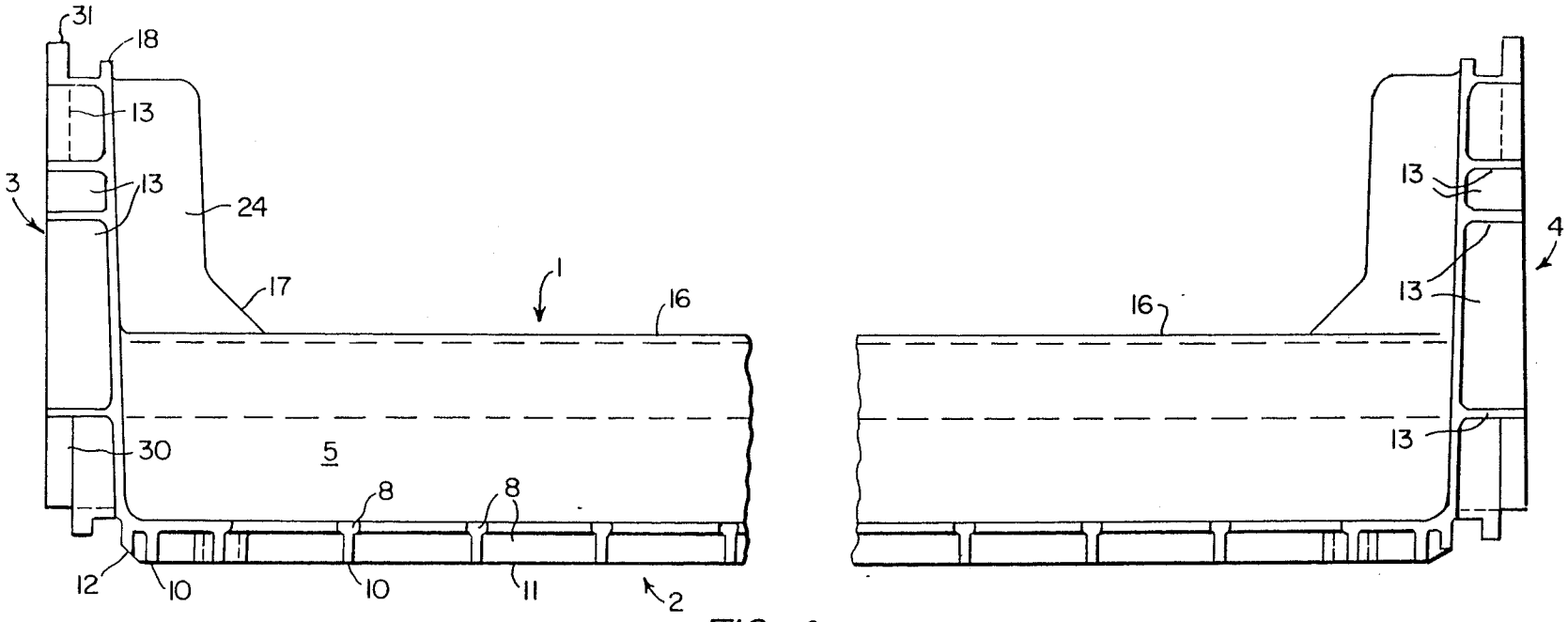
FIG. 4 is an elevational view, in cross-section, of one side of the tray according to the first embodiment, with the other side being identical.
Figure 5:
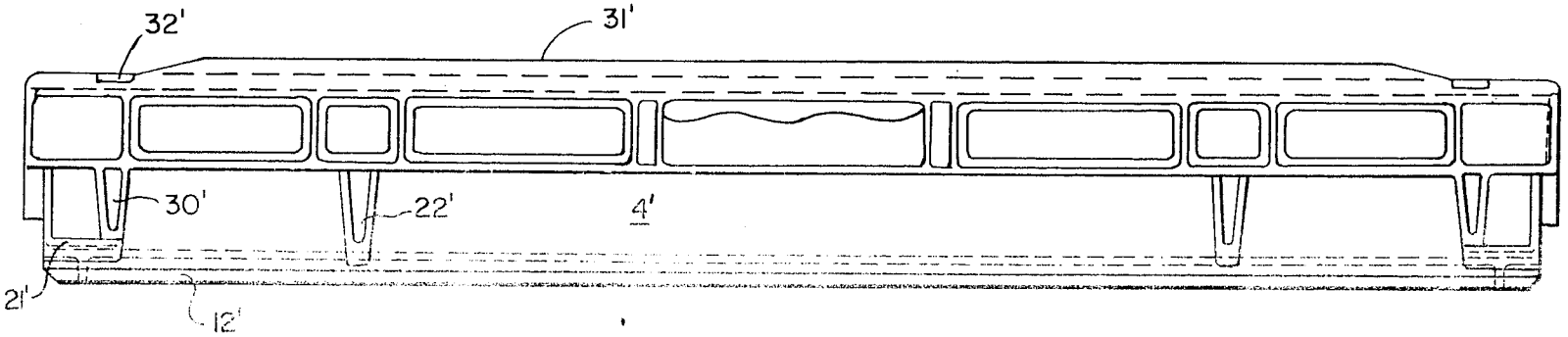
FIG. 5 is an elevational view of the end wall of a tray constructed according to the second embodiment employed alternatively with the different height trays of FIGS. 1-2.
Figure 15:
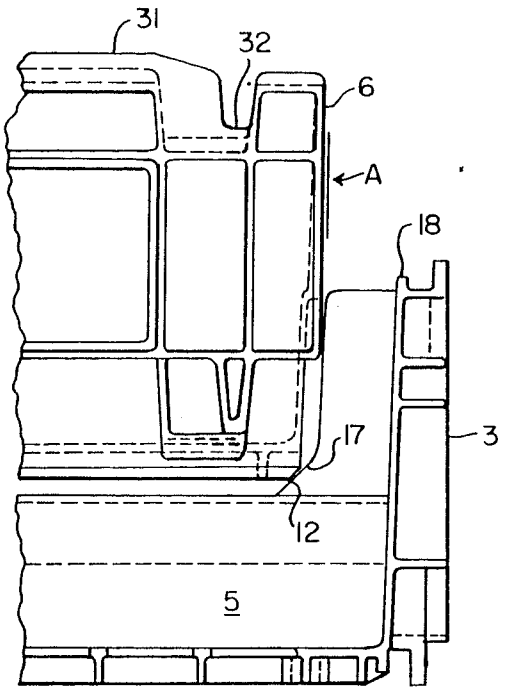
FIG. 15 is a partial view, taken in elevation from the side of the lower tray of two cross stacked trays in misaligned position.
Figure 14:
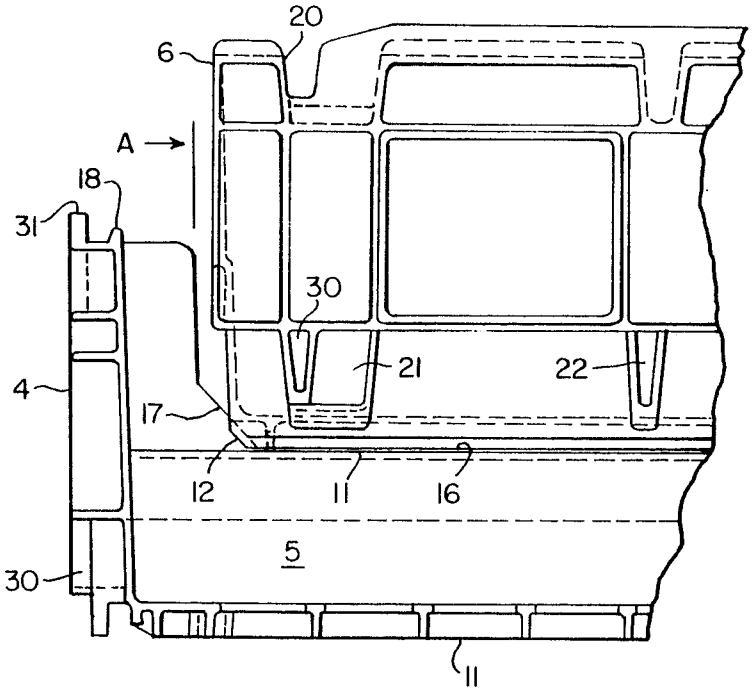
FIG. 14 is an elevational view of the side of a lower tray cross-nested with an upper tray in aligned position, with portions broken away.

The bakery tray of the first embodiment is shown in FIGS. 1, 2 and 4. The tray includes a generally rectangular bottom 2, a pair of opposed end walls 3, 4 and a pair of opposed side walls 5, 6. The walls are serially connected together at corners 7 around the perimeter of the bottom to produce an upwardly opening rectangular container or tray. As seen in FIG. 4, the end walls 3, 4 are higher than the side walls 5, 6, so that the trays may be stacked with adjacent like trays rotated in a 90 degree orientation with respect to each other, in a cross-nested relationship as shown in FIGS. 14 and 15. This type of structure is well known in the art.

The bottom structure is in the form of a grid, preferably a rectangular grid, of ribs 8 forming between them a plurality of at least similar small through passages 9 for aerating the bakery goods in trays and for providing lightness of the trays. As shown in the typical cross-sectional view of FIG. 4, the side walls 5, 6, the end walls 3, 4 and the ribs 8 all extend downwardly to terminal edges 10 that are coplanar to form a generally parallel horizontal bottom surface 11 interrupted substantially only by the through passages 9 and presenting the lowermost structure of the tray. This bottom planar structure of the terminal edges provides a tray support for providing abrasion resistance when sliding the tray and upper stacked trays that produce considerable weight on the lower tray along an abrading support surface. The abrading support surface could be a surface such as a concrete floor, which is rough and generally wears down plastic trays, particularly when the plastic trays of the prior art have a small support surface that is quickly worn down. With the tray of FIGS. 1–4, all of the terminal edges 10 of the bottom surface 11 will be contacting the support surface, such as a floor. When the support surface is discontinuous, for example with a roller bed or a floor having a crack, conventional trays have hung up on such a discontinuous surface because of their discontinuous bottom, which might result in jamming of automatic conveying equipment or breaking off of edges, for example when a large stack of trays is pushed across a floor having a crack.

According to several embodiments of the present invention, the tray is provided with the substantially planar support surface 11 that will not have such problems when encountering abrading and discontinuous support surfaces as are commonly provided during normal handling of such trays. This function of the tray support bottom surface is provided in all horizontal directions of relative movement between the tray and the support surface such as a conveyor or floor.

Chamfers 12 are provided along the entire edge perimeter of the bottom 2, so that the forks of a fork lift truck or the like moving along a support surface such as a floor may engage the bottommost tray of a stack of trays, more specifically engage the fork with the chamfer, to lift the bottommost tray upwardly and over the forks so that thereafter the forks may engage the generally planar horizontal bottom surface 11 of the bottommost tray that otherwise would be engaged in the support surface. In this manner, the chamber 12 provides a ramp extending upwardly and outwardly from at least the terminal edge of the walls 3, 4, 5, 6 and more specifically around the entire perimeter of the bottom. In addition, these chamfers 12 will assist in moving the trays, particularly with automatic conveying equipment, across a discontinuous surface, such as a roller or wheel conveyor. Further, these chamfers 12 will assist when moving the trays across a discontinuous surface, such as a floor having an upraised crack portion that will engage the chamfer surface 12, without any abrupt stoppage that in the past has broken conventional trays. Also, the chamfer surface 12 is important in preventing engagement with upraised cracks or the like in the floor that might stop the lowermost tray and cause the upper trays of a large stack to continue going forward to thereby upset the entire stack, which can produce considerable problems with respect to ruining bakery products and further breaking additional trays, in addition to providing increased labor time.

In the known manner of such trays, the walls are provided with outwardly extending reinforcing ribs 13, for example as seen in FIG. 2, which define a handle area 14, and open areas 15. To enable a person handling the trays by the handles to recognize like and 180 degree orientation by feel rather than by sight, handles 14 at one end wall 4 are provided with finger indentations **14*a***.

Returning to the cross-nesting feature as shown in FIGS. 14 and 15, it is seen that the interior distance between end walls and more particularly between points A, is substantially greater than the exterior distance between the side walls 5 and 6 so that the trays may be cross-nested, with 90 degree orientation between adjacent trays. This is accomplished by having the alternate trays of the vertical stack rotated about a vertical axis 90 degrees with respect to each other.

Figure 25:
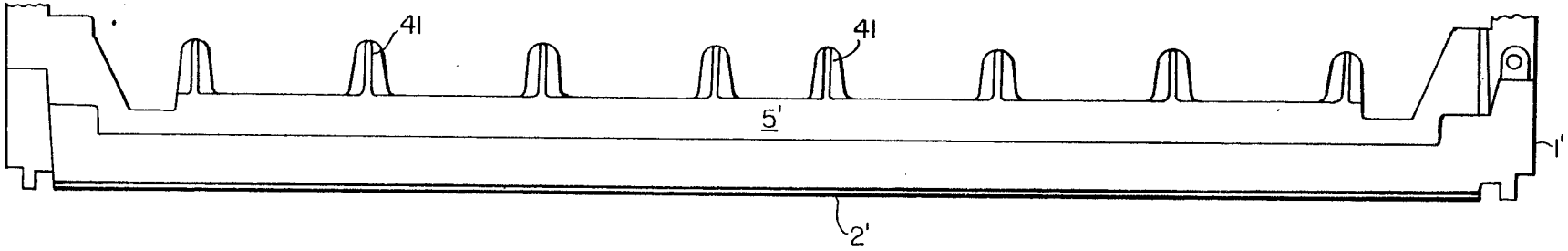
FIG. 25 is a partial elevational view, in cross-section, of one side of the tray constructed according to the second embodiment of the invention, with the other side being identical.

According to the first embodiment, the side walls 5 and 6 have a substantially linear continuous central top most edge 16 corresponding in length to the side to side width of the bottom surface 11 as measured parallel to the end walls 3, 4, for smoothly and continuously engaging the bottom of an upper tray with the near top most edge 16 during cross-nesting and thereby providing relative free sliding between the trays. In other embodiments, the side walls have product retention fingers, for example as shown in FIG. 25, that extend through the grid of the bottom of an adjacent upper tray during cross-nesting, to be explained in further detail hereinafter with respect to the second and third embodiments of the invention.

Each of the side walls 5, 6 is provided with a buttress portion 17 extending from opposite ends of the top most edge 16 upwardly and outwardly toward the higher end walls 3, 4, respectively. The buttresses portions 17 are at a spacing and orientation for engaging the ramps or chamfers 12 of an upper cross-nested tray, during nesting, as shown in FIGS. 14 and 15, to guide the trays relative to each other in the horizontal direction parallel to the side walls 5, 6 of the lower tray to an aligned position shown in FIG. 14 from a misaligned position shown in FIG. 15. This engagement between the buttress portions 17 and chamfers 12 facilitates aligned cross nesting and initially provides for offcenter room for quick cross-nesting and automatic alignment thereafter. This feature greatly facilitates automated handling, such as with automated assembly lines for cross-nesting the trays without the intervention of humans. Such misalignment and automatic alignment by the surfaces 12, 17, which are at complementary angles, provides considerable tolerances and is necessary for reliable machine cross-nesting in automated equipment.

It is to be understood that all of the above described cross-nesting structure could also be provided in the lower height end wall trays shown in FIGS. 3, 5, 6 and 25. However, the sidewall structure and cross-nesting of these trays is different, as shown, for purposes of illustrating another feature of an embodiment of the present invention.

Figure 7:
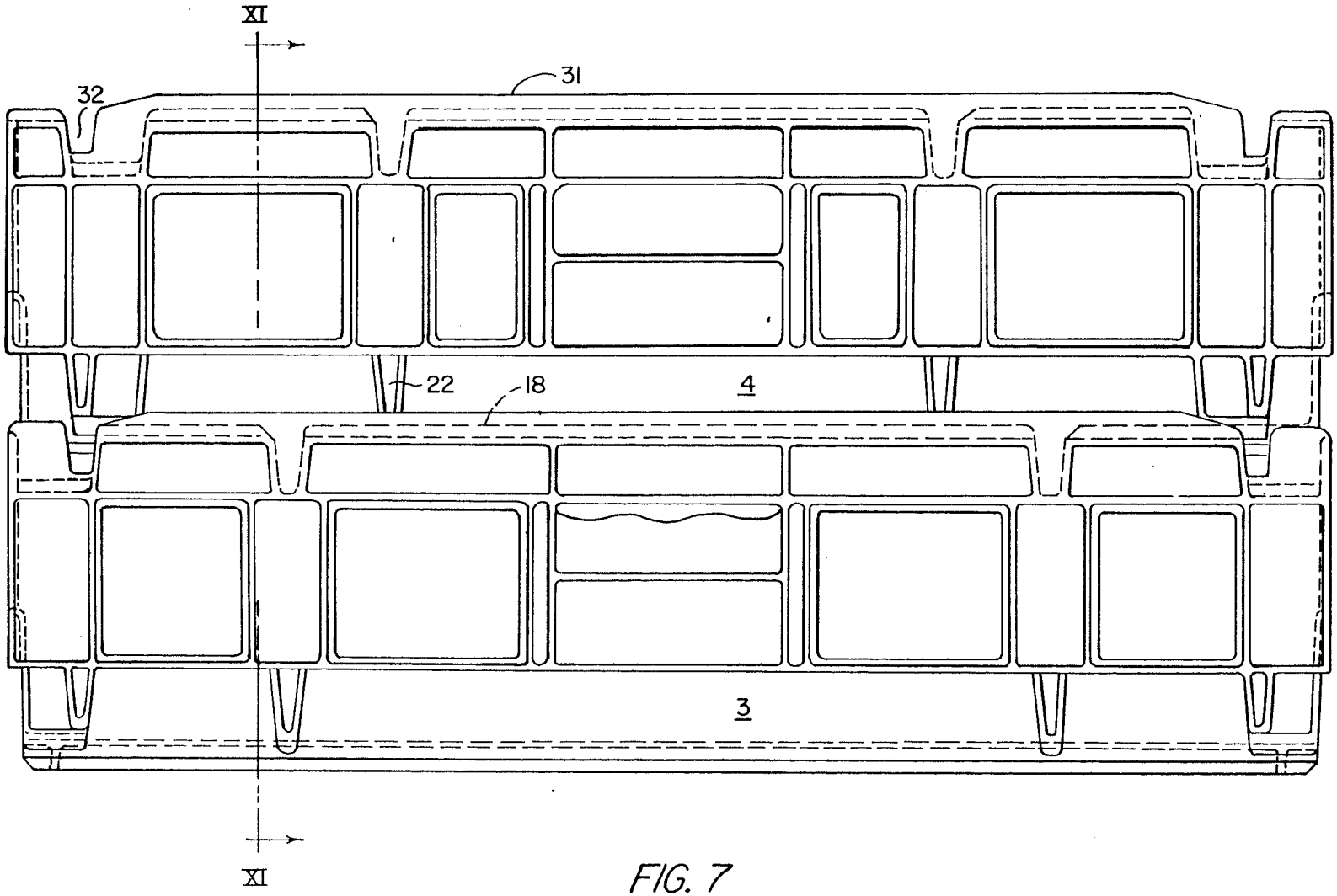
FIG. 7 is an elevational view of the ends of two like trays constructed according to the first embodiment stacked in a 18 degree oriented high position.
Figure 8:
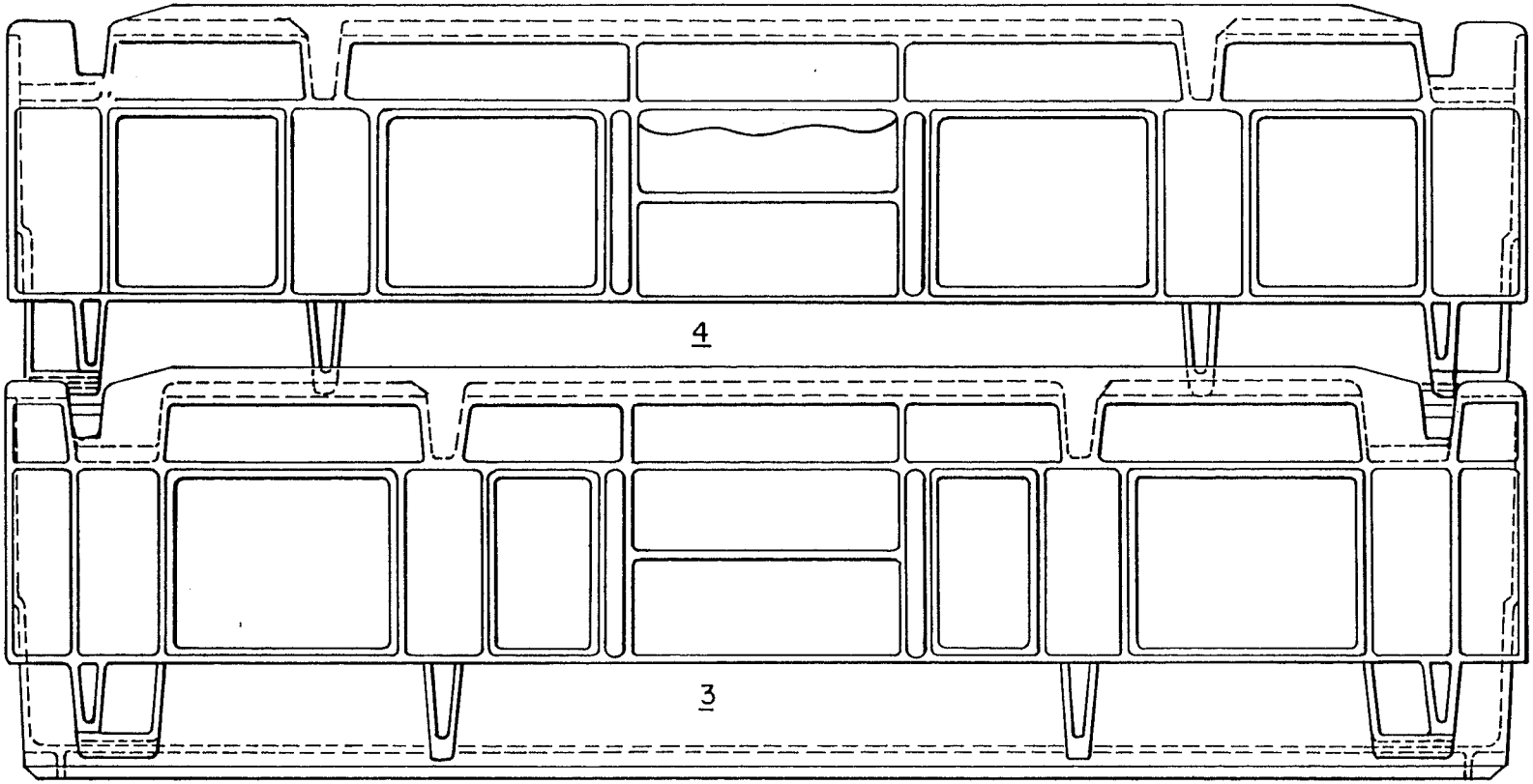
FIG. 8 is an elevational view of the other ends of the stacked trays according to FIG. 7.
Figure 9:
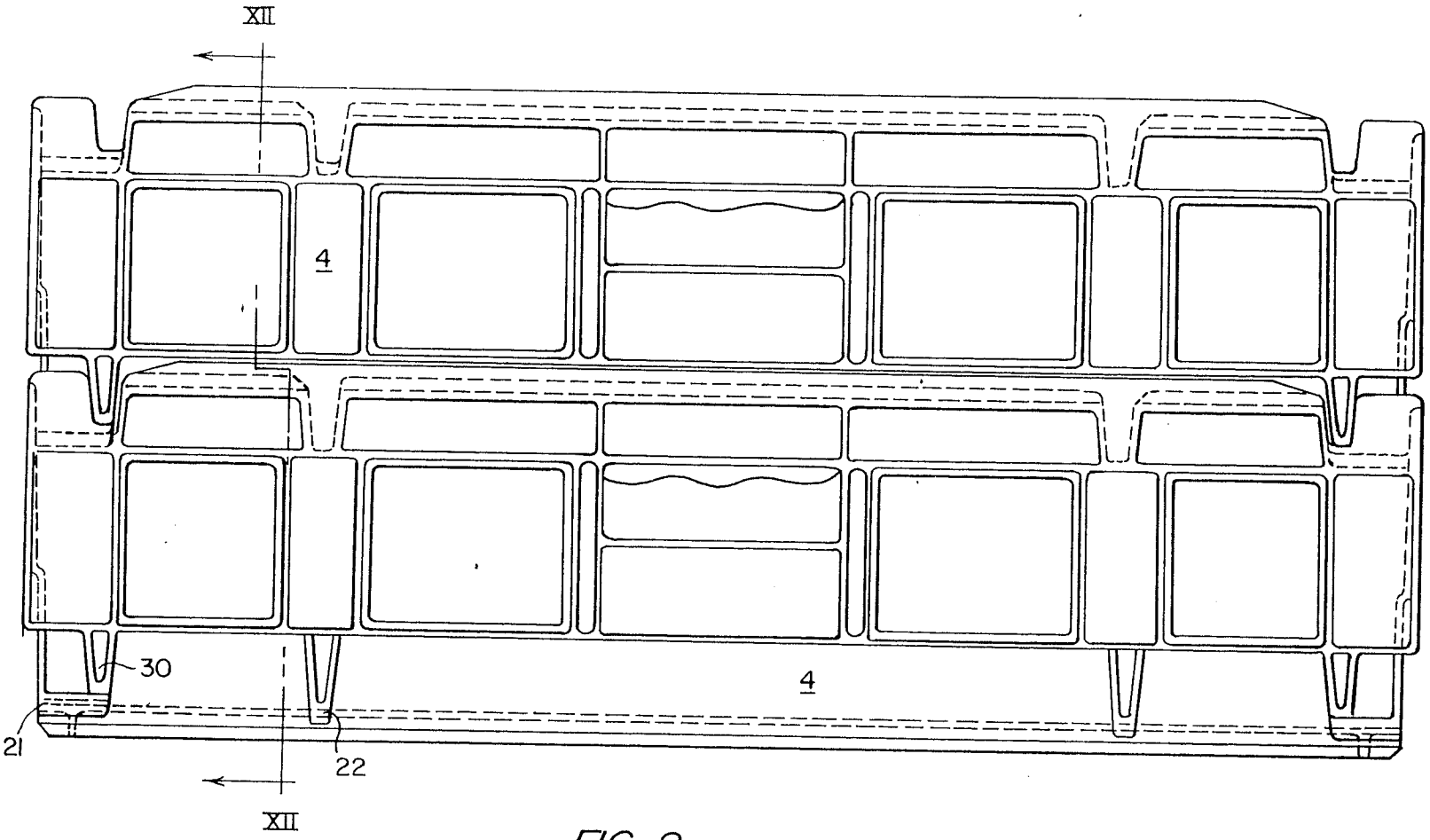
FIG. 9 is an elevational view of the ends of two like oriented trays stacked in a low or intermediate position.
Figure 10:
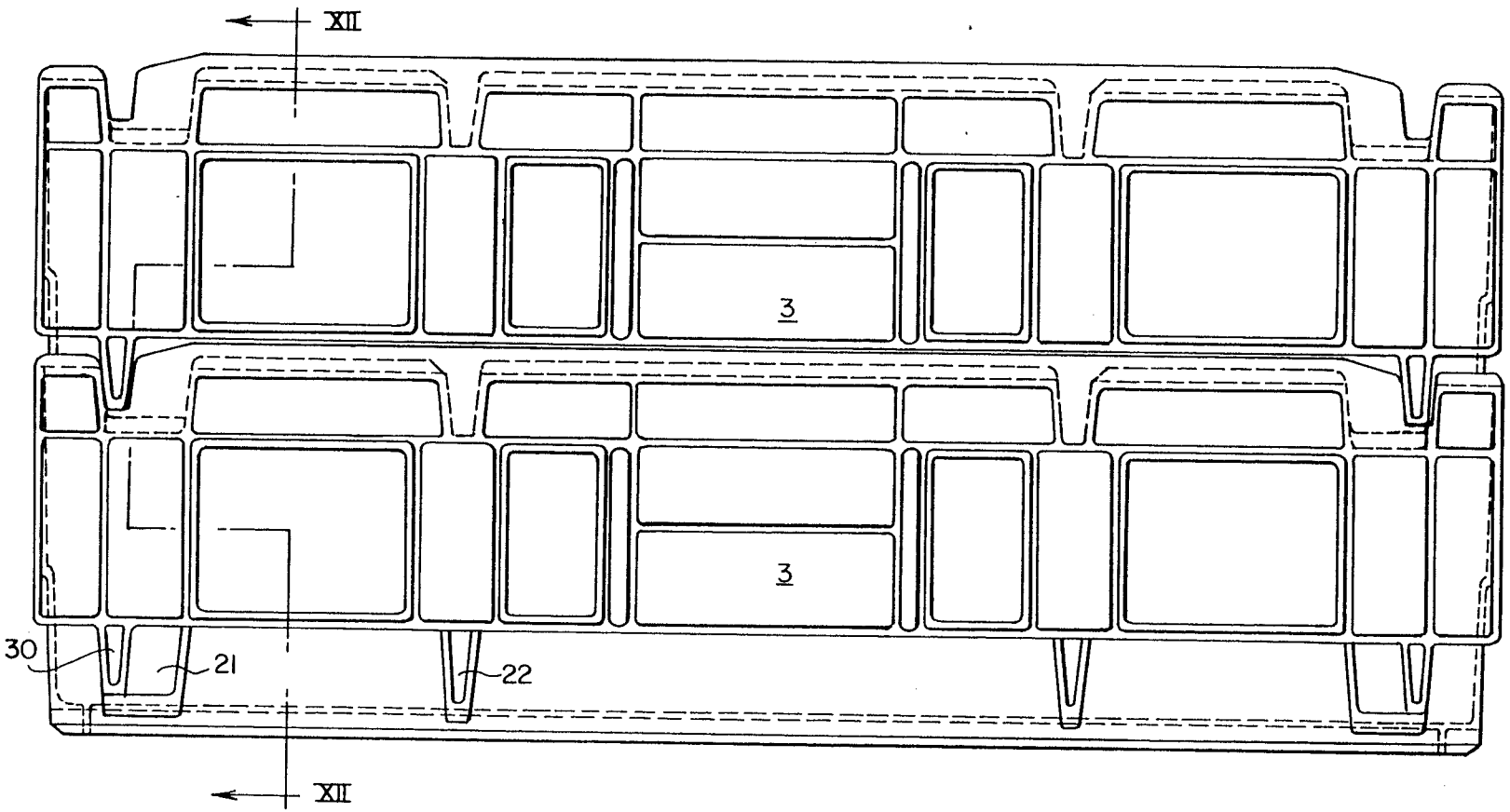
FIG. 10 is an elevational view of the opposite end of the stacked trays according to FIG. 9.
Figure 11:
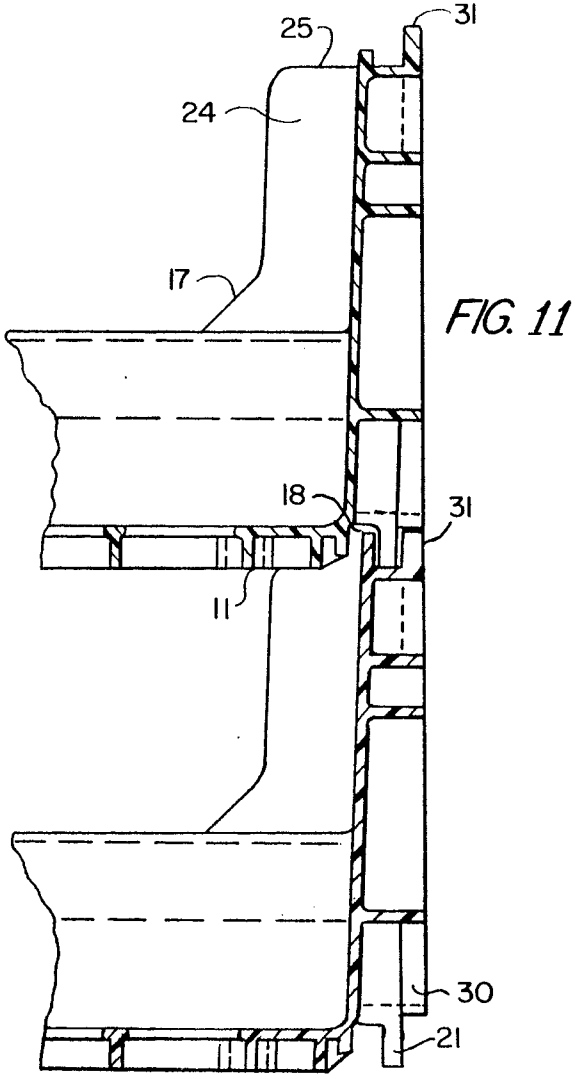
FIG. 11 is a partial cross-sectional view, in side elevation, of the trays stacked according to FIGS. 7 and 8, as taken along line XI—XI in FIG. 7.
Figure 12:
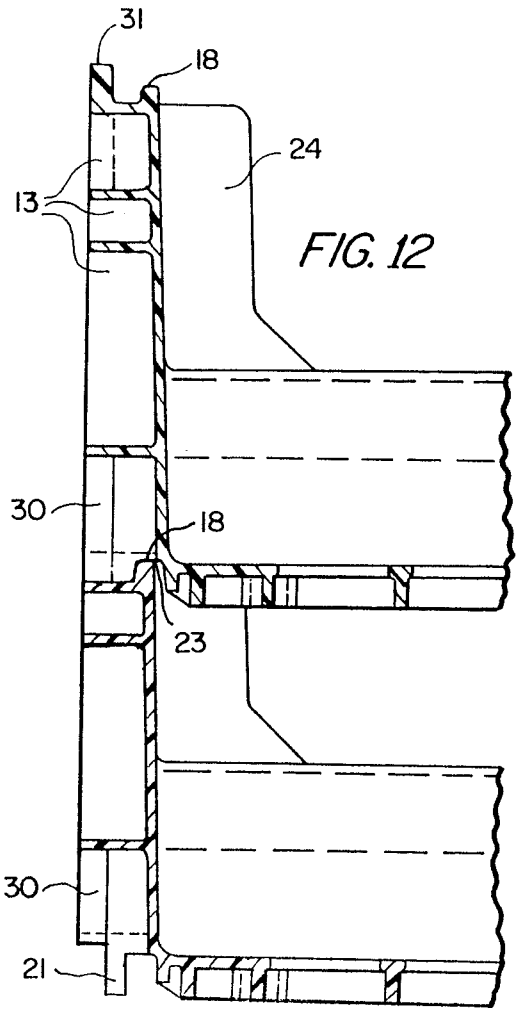
FIG. 12 is a partial cross-sectional view, in side elevation, of the trays being blind stacked according to FIGS. 9 and 10, as taken along line XII—XII in FIG. 9.

For the trays shown in FIGS. 1, 2 and 4, there is interengaging structure to provide for like oriented stacking of like trays at a low level or at an intermediate level if the cross-nesting is considered to be a low level. This like orientation is shown in FIGS. 10 and 12. Like trays may also be stacked in 180 degree orientation, that is rotated about a vertical axis 180 degrees with respect to adjacent trays stacked to produce high level stacking as shown in FIGS. 7, 8 and 11. The high level stacking, as is known, provides for the storage and transportation of high bakery products such as bread, the low or intermediate stacking provides for intermediate height products such as buns, and cross nesting facilitates the transporting of empty trays or storage and transportation of very low level products.

The interengaging structure of the trays of the first embodiment comprises an inside rail 18 and an outer stacking rail 31 along on the upper portion of each of the end walls 3, 4. Rails 18 and 31 form a channel 28 having a channel bottom **28*a*. Inside rail 18 functions as a guide rail along each of the end walls 3, 4. Rail 18 is provided with a pattern of at least two small recesses 19 and at least two large recesses 20 extending downwardly. The pattern of recesses in one rail 18, on end wall 3 is different from the pattern of recesses in the other rail 18, on the end wall 4, so that with 180 degree oriented stacked trays, as shown in FIGS. 7 and 8, vertically adjacent small recesses of adjacent trays will be misaligned vertically for each end wall of adjacent trays and vertically adjacent large recesses of adjacent trays will be misaligned vertically. The interengaging structure further includes a pattern of at least two large feet 21 and at least two small feet 22 along the bottom of each of the end walls 3, 4. The pattern of feet 21, 22 on one end wall 3 is different from the pattern of feet 21, 22 on the other end wall 4. This difference in foot pattern is such that with 180 degree oriented like stacked trays, vertically adjacent large feet will be vertically misaligned and vertically adjacent small feet will be vertically misaligned with at least some of the feet engaging the channel bottom 28*a* to provide the high position. In the like oriented position of two stacked like trays shown in FIGS. 8 and 10**, the large feet of the upper tray will be received within the large recesses of the lower tray and the small feet of the upper tray will be received within the small recesses of the lower tray to provide a low stacked position. In the positions shown in FIGS. 7, 8, 9 and 10, it is seem that for each end wall 3, 4, all of the large and small feet are coplanar with each other and coplanar with all of the large and small recesses.

The blind stacking of the trays according to the present invention is achieved by a blind stacking structure according to different embodiments of the invention. The preferred blind stacking structure includes the large feet and additional outer guide feet structure, wherein guide feet engage the outer stacking rail to guide an upper tray across the end walls of a lower tray. Alternatively, as shown in FIGS. 26–29, the blind stacking structure can include only the large and small feet 21''' and 22''' respectively in cooperation with the large and small recesses without the need for additional outboard blind stacking or outer guide feet structure.

The outboard blind stacking structure will now be described generally, with reference to the first embodiment specifically. Guide feet 30 are provided at opposite ends of each of the end walls 3, 4, adjacent the bottom. As seen, for example in FIG. 12, the guide feet 30 are outwardly spaced from and separate from the interengaging structure. The stacking rails 31 have recesses 32 at the opposite ends of the end walls 3, 4, which recesses 32 are vertically aligned with the guide feet 30 and correspondingly shaped to receive the guide feet 30 of a similarly constructed or like constructed tray. The reception of the guide feet 30 within the guide recesses 32 is to a nesting depth of like containers sufficiently for the above-described interengaging structure to provide each of the high and intermediate or alternately stated high and low positions of 180 degree orientation and like orientation of adjacent stacked like containers. The stacking rails 31 between the guide recesses 32 are linear, flat along upper surface and preferably horizontal, of continuous height and constructed to receive and support thereon the guide feet 30, as shown in FIG. 11, of an upper container during blind stacking at the far side and even the near side. Engagement of the guide feet 30 with the stacking rail 31 maintains like oriented and 180 degree oriented like containers vertically spaced at a height greater than the above-mentioned high level stacking and thereby greater than the above-mentioned low and intermediate stacking height. Therefore, with blind stacking of like containers, the guide feet 30 engage the upper surface of the guide rail 31 slidably along the entire length of the guide rail 31 to maintain the interengaging structure spaced from each other and maintain the interengaging structure inoperative until the guide feet 30 align with and interengage or nest with the guide recesses 32, at which time, the interengaging structure can provide the high and low stacking.

All of the blind stacking features described above are equally attainable with the low level trays of FIGS. 3, 5, 6 and 25, wherein like structure is provided with like numerals. Of course, since the high level is not provided with the low trays of this second embodiment, the inner guide rail 18' is not provided with recesses, thus eliminating intermediate and high level stacking.

The above-mentioned blind stacking features have related to the forwardmost edge of the top container. There are also blind stacking features relating to the rearwardmost portion of the lower container that engages the bottom of the upper container. with specific reference to FIG. 11, the buttress portions 17, are connected to high wall portions 24 of the side walls that have top planar surfaces 25 for engaging the planar bottom surface 11 of a like top tray at the near end, with respect to an operator conducting blind stacking, of like oriented and 180 degree oriented trays. Engagement between the top edge 25 and the bottom surface 11 of adjacent trays during blind stacking at the near portion to the operator occurs linearly and smoothly without interruption throughout the entire blind stacking process coincident with the blind stacking process described above. That is, the surface 25 provides linear sliding engagement continuously during blind stacking to support the near portions of like containers while the far portions of like containers are supported with respect to each other by the guide feet traveling upon the stacking rail 31.

Figure 13:
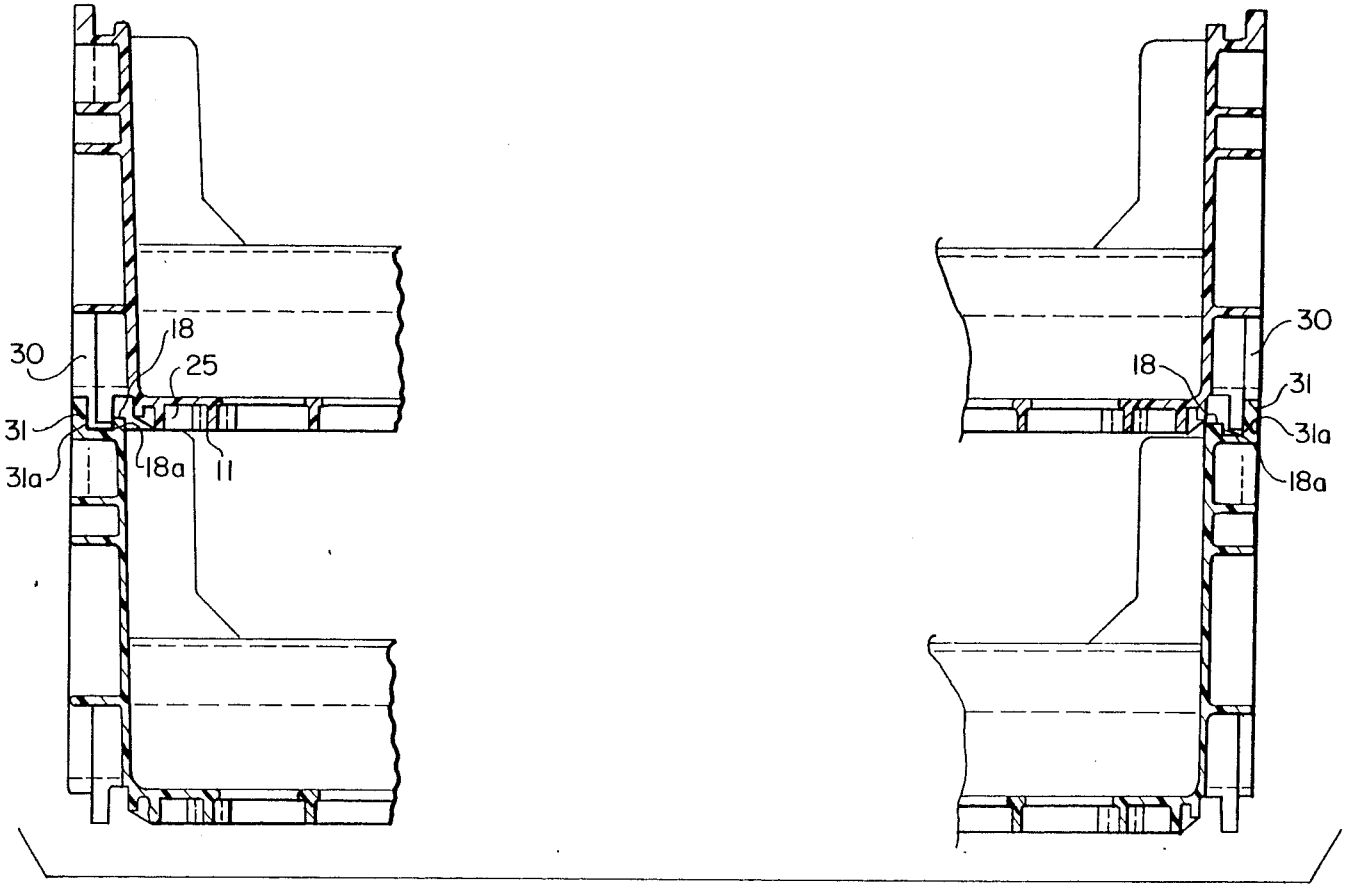
FIG. 13 is a cross-sectional view, with the center portion broken away, taken along line XIII—XIII in FIG. 16, blind stacking being shown.

According to another feature of the blind stacking of the trays constructed according to the present invention, the large feet 21 extend downwardly into a channel formed between an inner wall 31*a* of stacking rail 31 and an outer wall 18*a* of guide rail 18. This feature is in all of the embodiments, but is best shown with respect to the embodiment shown in FIGS. 13, and 16–19 wherein the feet 21 extend flush to the bottom of the tray such that the second embodiment of the tray disclosed by these figures is modified from the first embodiment. As shown in FIG. 13, the bottom 23 of the large feet 21 extend into the channel but do not touch the bottom surface 28 of the channel so that increased sliding resistance during blind stacking is prevented. It is preferred that the large feet extend into the channel to resist lateral movement of an upper tray being blind stacked onto a lower tray by confining the movement of the bottom portion of the foot within each of rails 18 and 31.

Lateral movement is confined, more specifically, by the dimensional relationship between the large feet 21 of an upper tray and the spacing between the inner guiding and outer stacking rails, respectively, of a lower tray. As shown in FIG. 13, the large feet can engage the inner walls 31*a* of the stacking rail 31 along each end of the lower tray to maintain side-to-side alignment of an upper tray with respect to a lower one during blind stacking. As shown in the left-hand side of FIG. 13, there is preferably a small predetermined clearance between the large feet 21 of the upper tray and the inner wall 31*a* on the left side (as shown) of the lower tray when the large feet 21 at the opposite end of the upper tray are in engagement with the inner wall 31*a* of the stacking rail 31 at the right side (as shown). This clearance can be as wide as the width of the channels. If the clearance is as wide as the channels, then the large feet 21 of an upper tray engage the inner wall 31*a* at one end (right side as shown) of a lower tray while at the other end of the tray, the large feet engage the outer wall 18*a* of the inner guide rail 18. Thus, during blind stacking of the trays, small relative lateral movements of an upper tray with respect to a lower tray can be tolerated.

Figure 16:
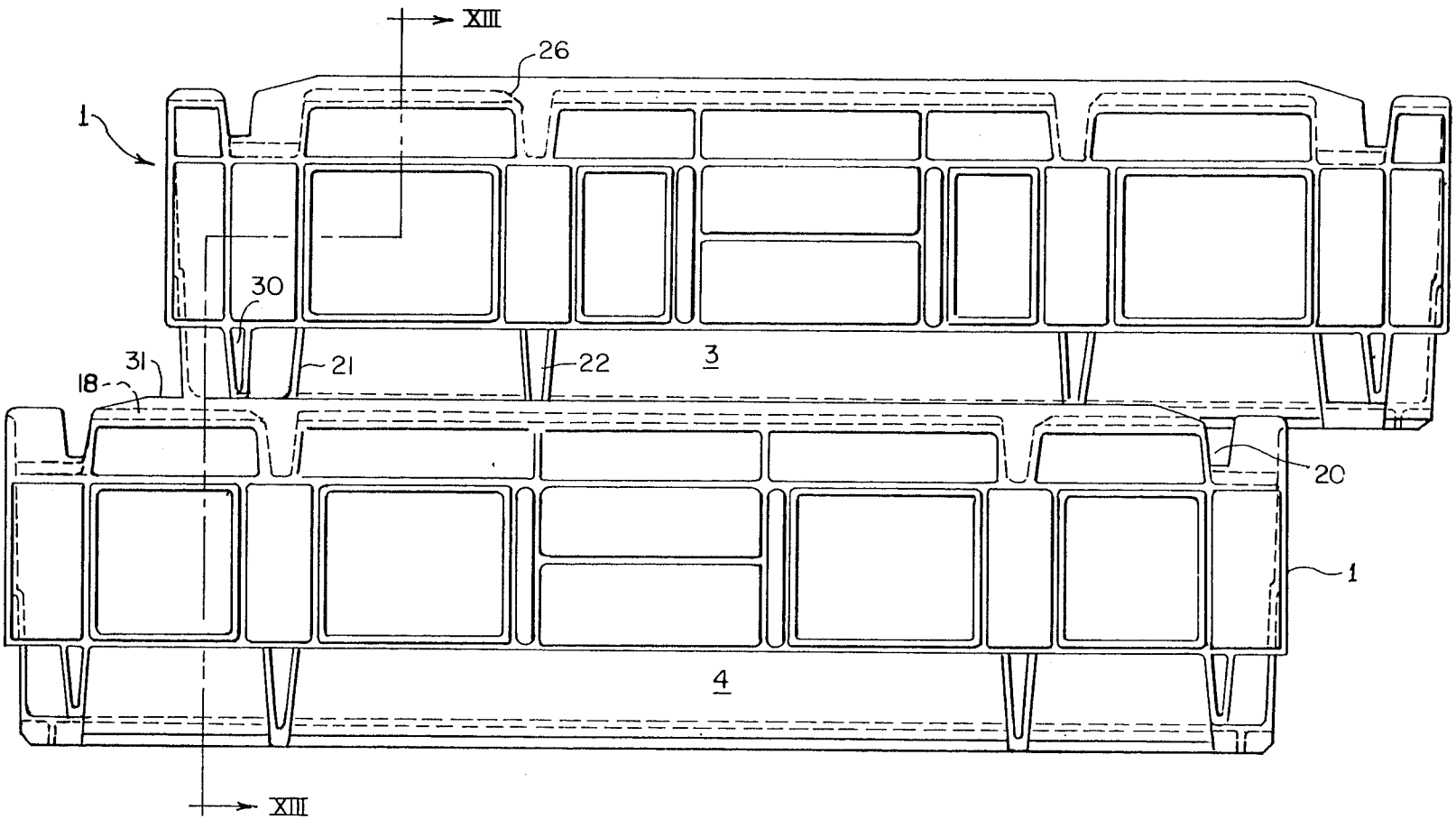
FIG. 16 is an elevational view of the ends of two 180 degree oriented trays constructed according to a modification of the first embodiment sliding along each other during blind stacking.
Figure 17:
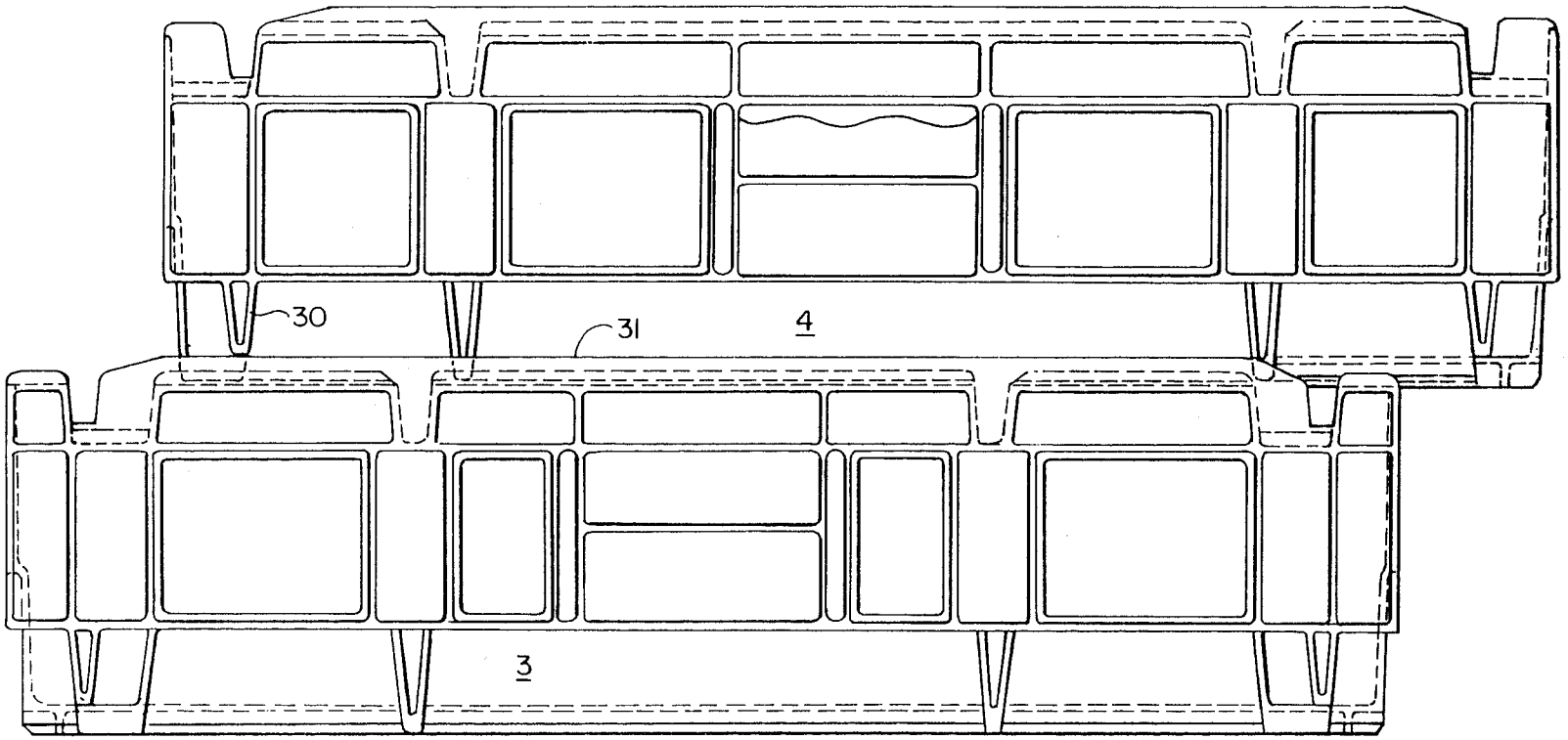
FIG. 17 is the opposite end elevational view of the blind stacking of trays shown in FIG. 16.
Figure 18:
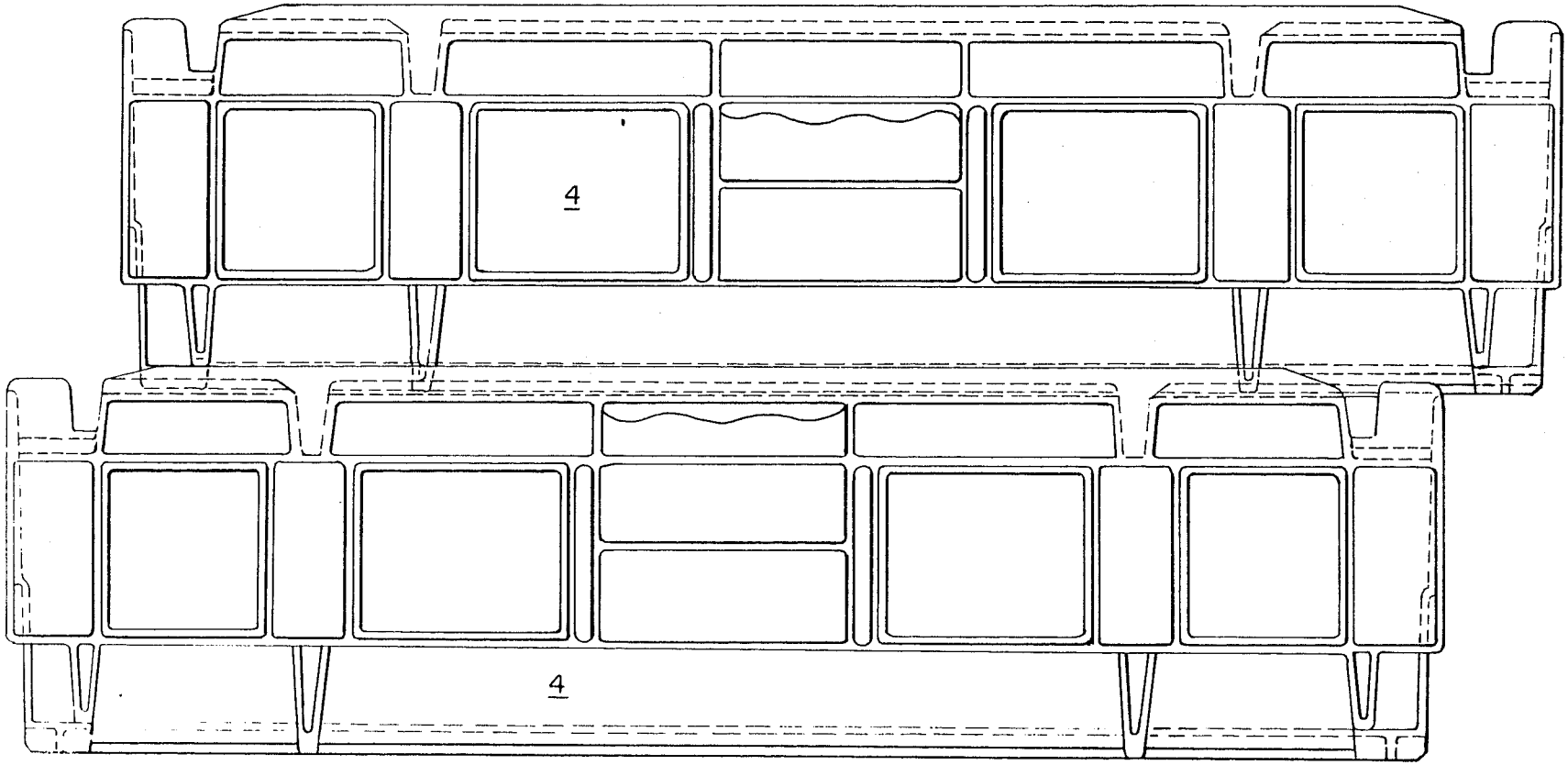
FIG. 18 is an end elevational view of like oriented trays constructed according to the modified embodiment of FIG. 16 being blind stacked.
Figure 19:
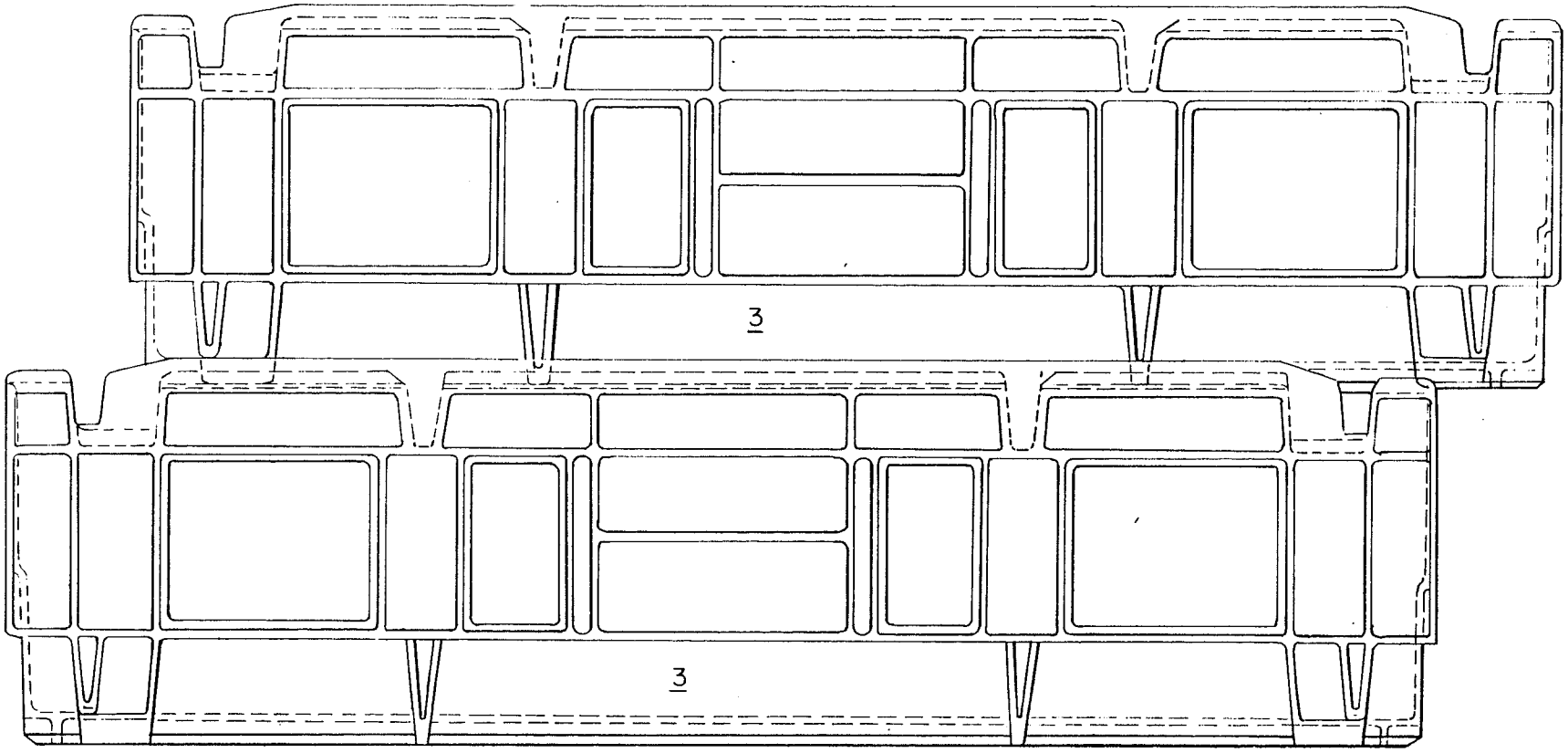
FIG. 19 is an elevational view of the other end of blind stacking of trays shown in FIG. 18.
Figure 20:
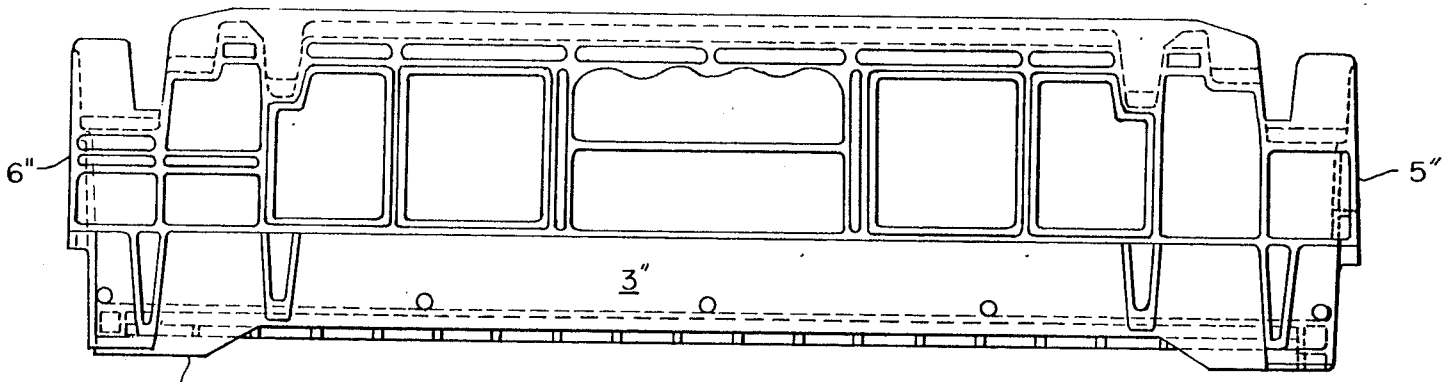
FIG. 20 is one end elevational view of a tray, according to the present invention, showing a third embodiment.

To further aid in blind stacking the trays of each of the embodiments constructed according to the invention, the small recesses have a tapered wall portion 26 that guides the leading edge of an upper tray out of engagement with the small recesses as the step of blind stacking an upper tray on a lower tray is nearly completed. As shown in FIG. 16, the trays being blind stacked on one another are nearly parallel at the forward edge of the upper tray as it crosses the small recess, so engagement of the forward edge of the upper tray with the small recess is unlikely. However, should the trailing edge of the upper tray be lifted in relation to the lower tray, then the tapered wall portion 26 would guide the front edge smoothly over the opening of the small recess to enhance the free sliding movement during blind stacking of the upper tray onto the lower one.

Figure 21:
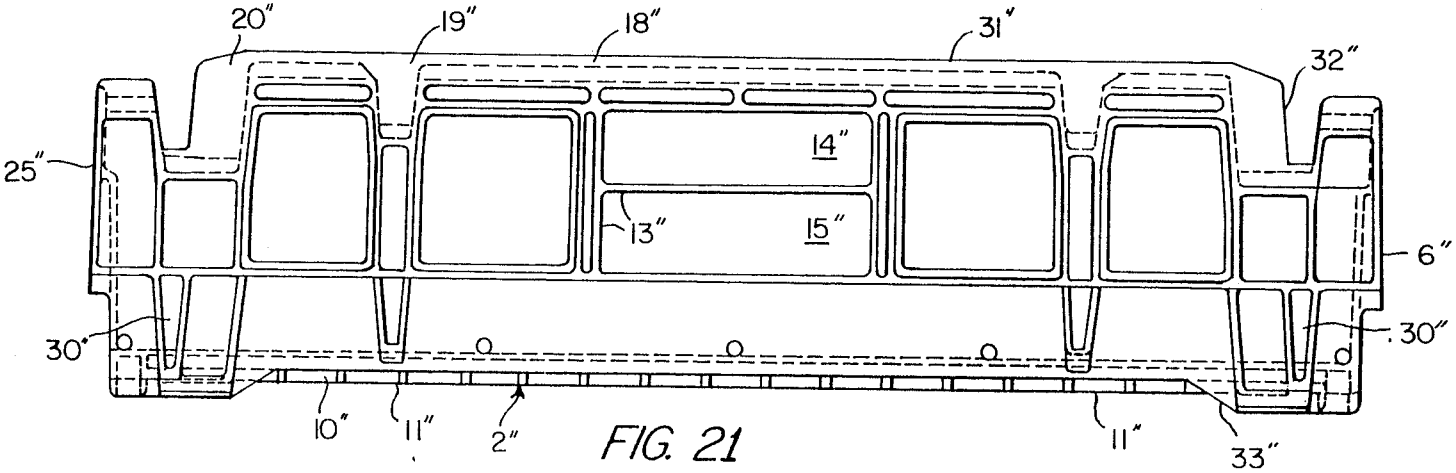
FIG. 21 is the opposite end elevational view of the tray according to FIG. 20

The third embodiment of the tray of the invention is shown in FIGS. 20–24. Substantially the same interengaging structure and outboard blind stacking structure are provided as previously described, with it being noted that the guide feet 30″ and guide recesses 31″ extend downwardly to a greater extent than their counterparts of the first embodiment and correspondingly the large feet and large recesses extend downwardly to a greater extent than their counterparts of the first embodiment. This greater depth is correlated to the provision of greater depth corner structure with respect to the second embodiment at the bottom and lower height corner structure at the top. As shown in FIG. 21, the bottom surface 11″ terminates at a position spaced from each adjacent bottom corner, also evident from FIG. 22. This provides inwardly facing corner flanges 33 that are horizontally outward and vertically downwardly extending from the adjacent bottom surface 11″. The corner flanges are at the opposite terminal ends of each of the side walls 5″, 6″.

With the tray of FIGS. 20–24, the downwardly extending corner structure provides the flat bottom surface 11″ sufficiently spaced above a support surface, such as a floor, so that a fork lift truck or the like may extend its forks easily beneath the tray without the provision of the chamfers 12 of the embodiment according to FIGS. 1, 2 and 4. Additionally, the flat planar bottom surface 11″, particularly described with respect to the other embodiments provides, in FIGS. 20–24, the flat bottom surface that will, without interruption, engage a discontinuous support surface such as a roller conveyor to provide for full automation, with the depending corners being beyond the support of the narrower conveyor. Also, the flat bottom surface of the corner portions 34 will engage the upper edge 25″ of the buttresses, at the near side, during stacking in the cross-nested position to function as previously described with respect to the first embodiment. Further, the corner flanges 33 engage upper edges 25″ as the trailing edge of an upper tray slides across the lower tray at the completion of a blind stacking step. Accordingly, the trailing large feet and guide feet are correspondingly raised to clear the side wall allowing the large feet to engage within the channels along each end wall. In view of the similarity, as evidenced by like numerals, between the two embodiments, further description of the embodiment of FIGS. 20–24 is unnecessary.

Figure 26:
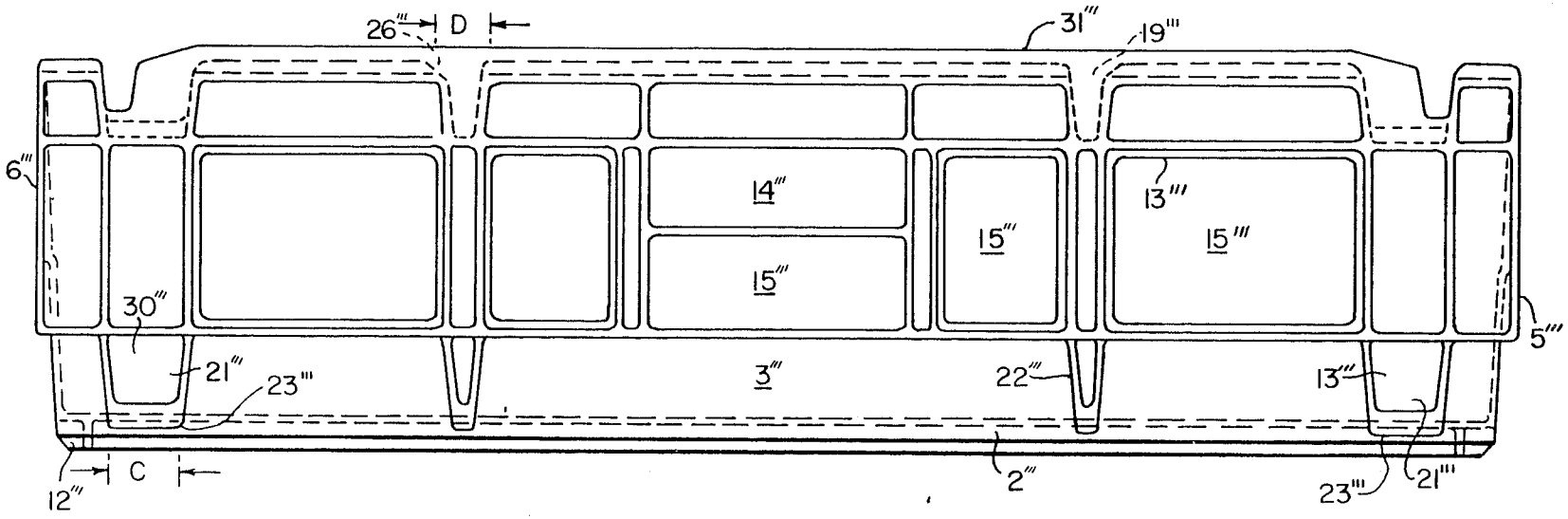
FIG. 26 is an elevational end wall view of a tray constructed according to a fourth embodiment of the present invention.
Figure 27:
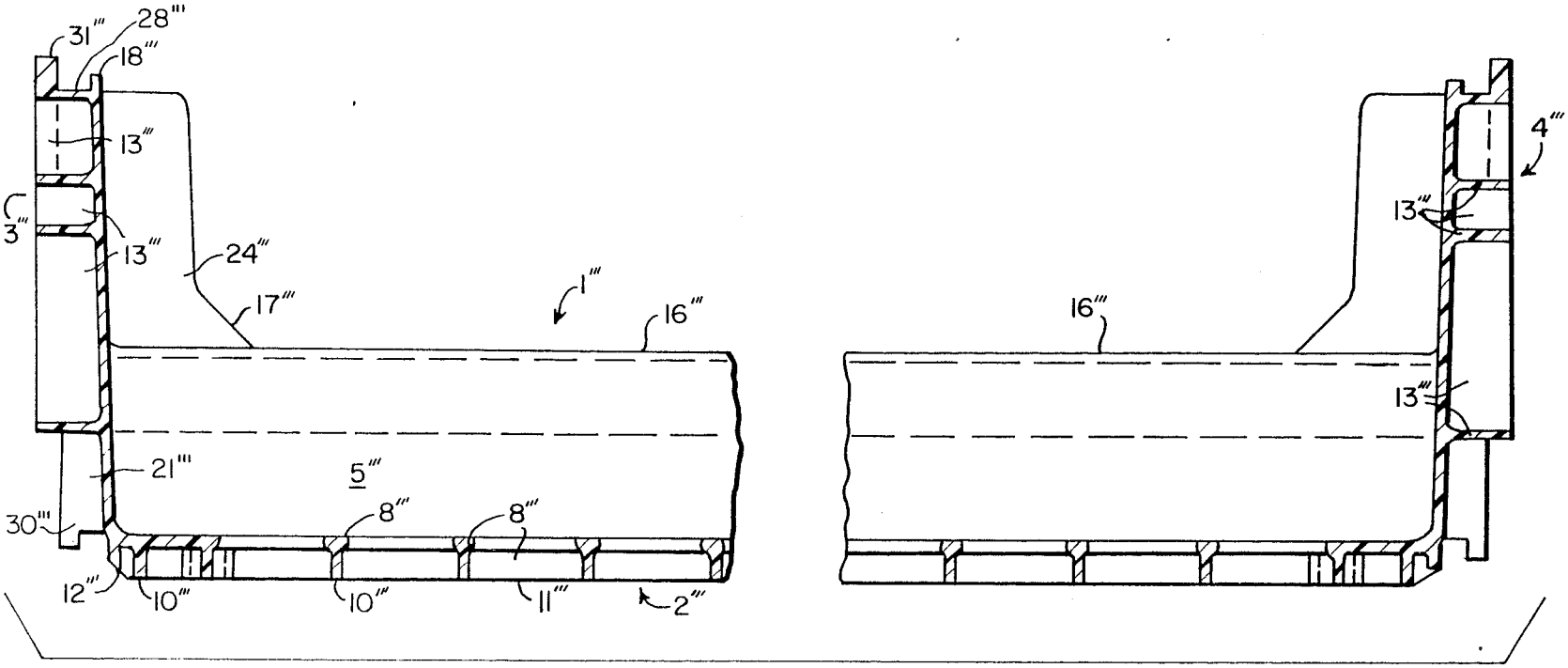
FIG. 27 is an elevational view, in cross-section, of one side of the tray according to the fourth embodiment, with the other side being identical.
Figure 28:
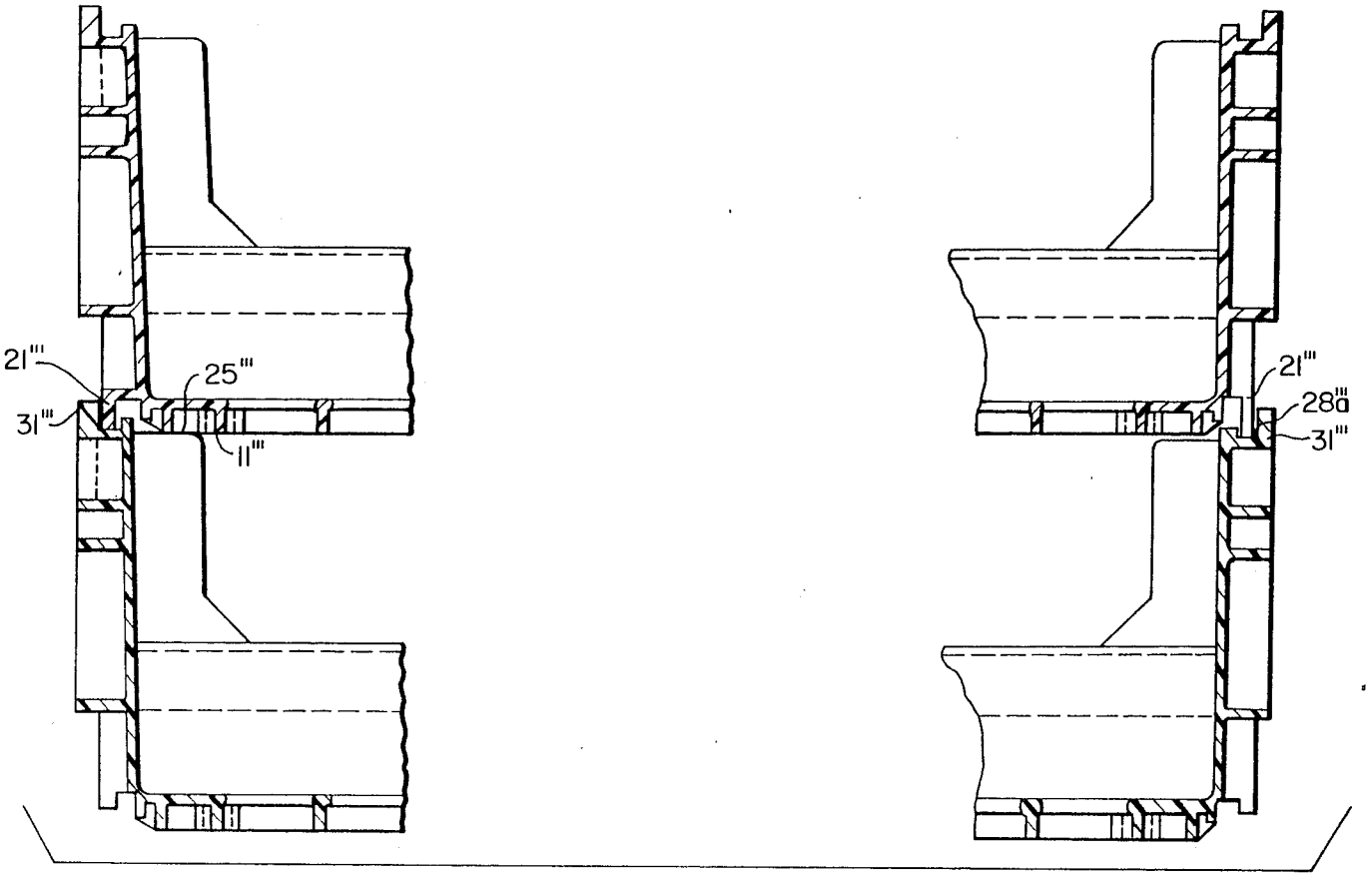
FIG. 28 is a cross-sectional view, with the center portion broken away, taken along line XXVIII—XXVIII in FIG. 29, blind stacking being shown.

In the fourth embodiment of the invention, shown in FIGS. 26–29, blind stacking is provided with continuous linear sliding engagement between upper and lower trays for both like orientation and 180 degree orientation in an alternative manner. The large feet 21‴ are coplanar with and outward, in the sliding direction parallel to the end walls 3‴, 4‴, of the small feet 22‴; and the large recesses 20‴ being coplanar with and outward, in the sliding direction parallel to the end walls of the small recesses 19‴. Further, rail 18‴ is linear and uninterrupted between the recesses. The large feet 21‴ have a bottom continuous linear sliding engagement surface 23‴, that extends downwardly into the channel formed between rails 18‴ and 31‴ to engage the bottom surface **28*a*‴ of the channel 28‴. Similarly as shown in FIG. 26, feet 21‴ have a length in the sliding direction C, that is greater than the length D, in the sliding direction, of the distance between the continuous linear surfaces on opposite sides or across the small recess. This relationship of C greater than D provides for smooth sliding of the large feet 21‴ along the bottom surface of the channel formed between rails 18‴ and 31‴ even as the small recesses 19‴ are traversed by the large feet 21‴**.

It is seen that if the feet 21‴, 22‴ and recesses 19‴, 20‴ were all the same size, which is not true in the present invention, then the foot 21‴ would tend to fall within the recess 19‴ and produce a discontinuity in the sliding motion during blind stacking, which could tend to knock over a stack of trays, produce annoyance with the operator and lost time, or prevent the use of automated equipment for blind stacking.

Figure 29:
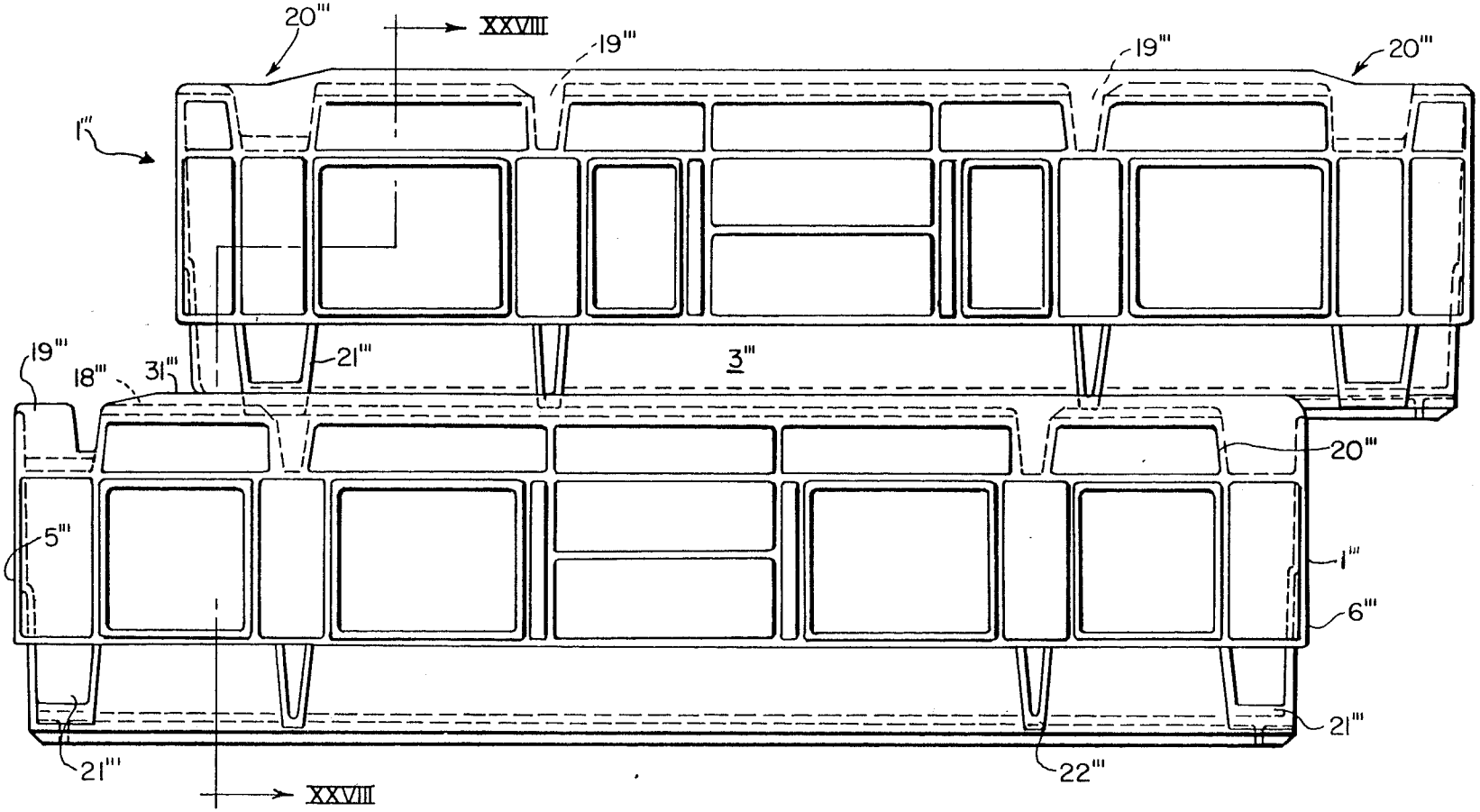
FIG. 29 is an elevational view of the end of two 180 degree oriented trays constructed according to the fourth embodiment of the invention sliding along each other during blind stacking.

As shown in FIG. 29, the pair of large feet 21 are closely adjacent the side walls 5‴ and 6‴ and the pair of larger recesses 20‴ are closely adjacent the side walls 5‴ and 6‴, so that the small feet 22‴ and small recesses 19‴ are effectively between the large feet 21‴ and large recesses 20‴, respectively. Thereby, the blind stacking provided by the fourth embodiment of the present invention provides continuous uninterrupted sliding engagement between the forwardmost large feet 21‴ shown in FIG. 29 of the upper tray as they slide over the small recesses 19‴.

In addition to or in place of the far side, with respect to the operator during blind stacking, blind stacking features described above, the following outboard blind stacking features may be provided. As noted above, the interengaging structure providing high and intermediate level stacking is preferably all coplanar and in addition provides blind stacking functions at the far portion. The outboard blind stacking structure is spaced outwardly of the plane for the interengaging structure, for each of the end walls; the structure could be modified by placing the outboard structure inboard in an equivalent manner.

In each of the embodiments of the trays constructed according to the present invention, the interengaging structure permits stacking of trays of one embodiment with another embodiment to attain the high and low stacked positions, except in the case of the trays constructed according to FIGS. 3, 5, 6 and 25 wherein only one height of stacking is attainable. Further, blind stacking is permissible between trays of each of the embodiments, but it is preferred that the outboard blind stacking structure be included to provide restraint against lateral shifting during blind stacking of trays.

Figure 3:
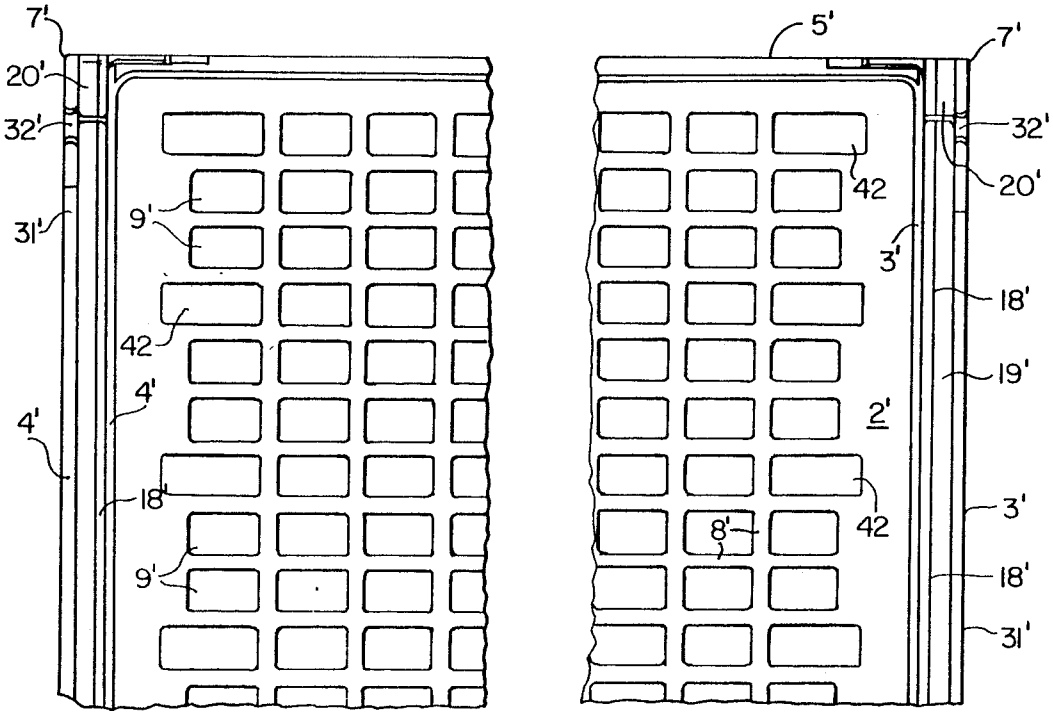
FIG. 3 is a partial top view, the center portion having been removed to avoid duplication, of the bottom one-half of a tray constructed according to a second embodiment of the invention, with the other one-half of each tray being a mirror image.
Figure 22:
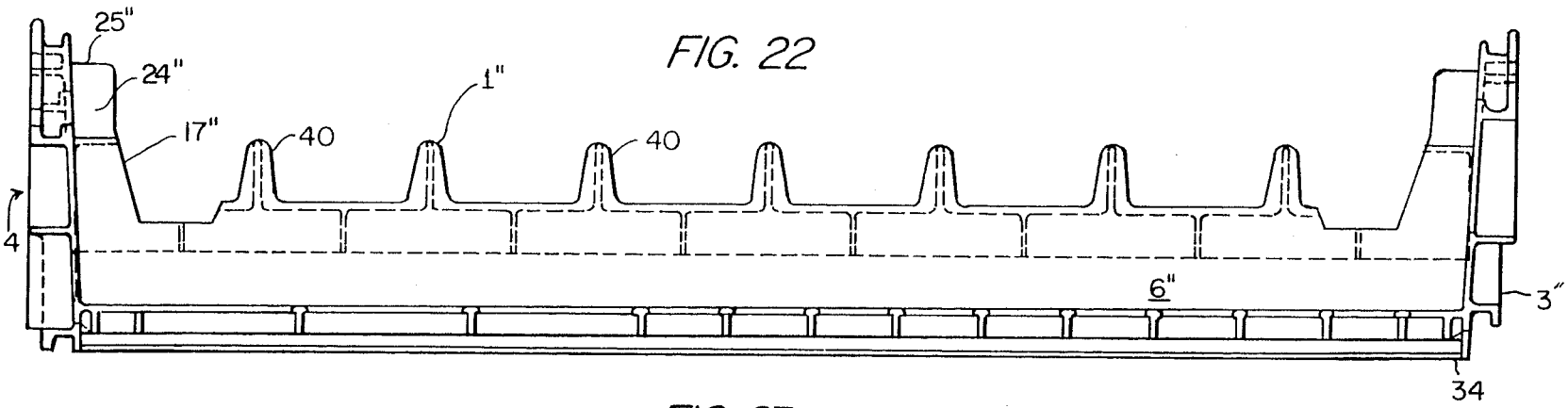
FIG. 22 is a side elevational view, taken in cross section along line XXII—XXII of FIG. 23, of the tray according to FIG. 20, with the cross-sectional view along the same cross-section line taken in the opposite direction being a mirror image.
Figure 23:
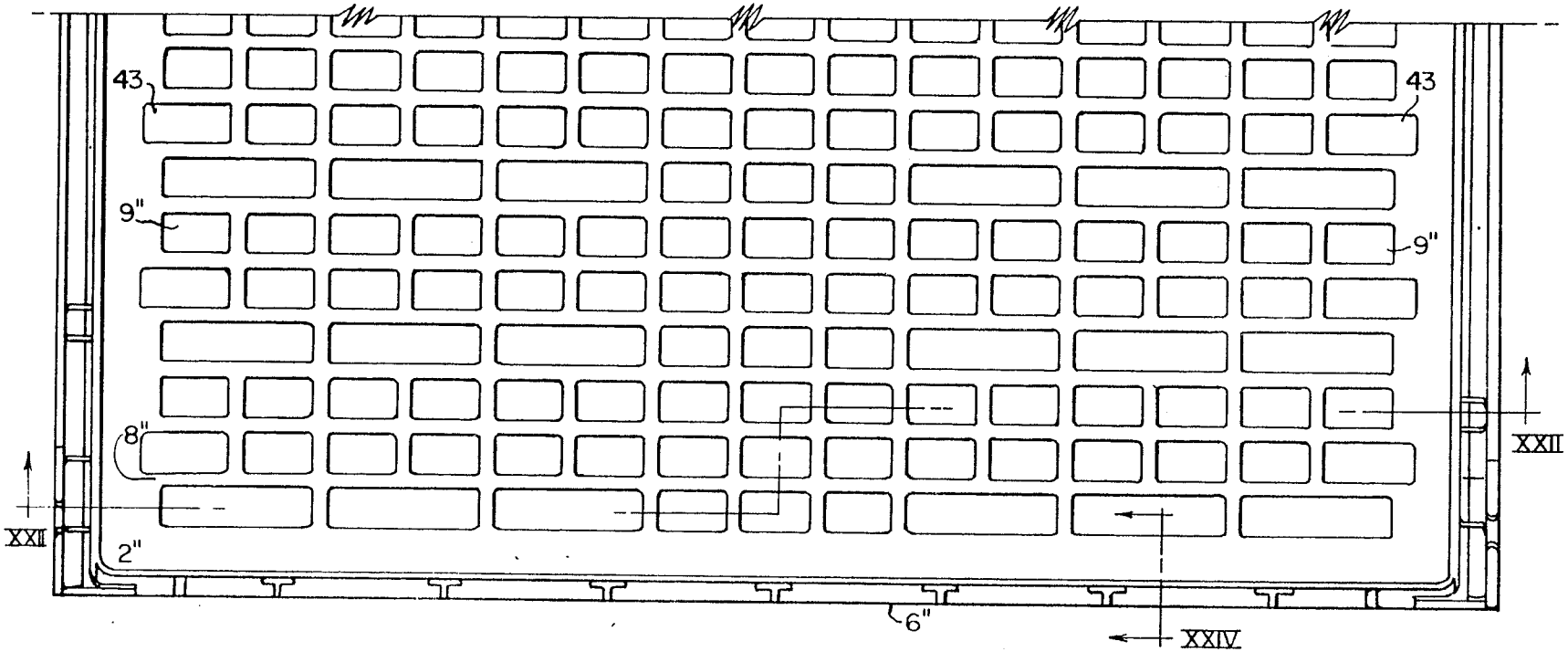
FIG. 23 is a top plan view, of one-half of the tray as shown in FIG. 20, with the other half being a mirror image.
Figure 24:
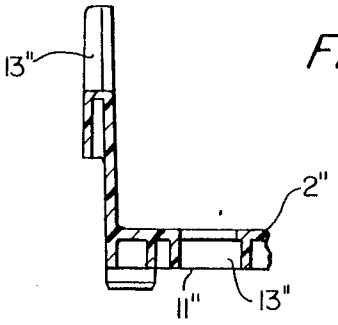
FIG. 24 is a partial cross-sectional view taken along line XXIV—XXIV in FIG. 23.

As mentioned, in cross-nesting the adjacent trays are 90 degree oriented. The trays of the first and fourth embodiments have a top edge along the side wall that is smooth or continuous and uninterrupted. However, according to another feature of the invention, the side walls of the trays constructed according to the second and fourth embodiments, as shown in FIGS. 22 and 25 respectively, have product retention fingers 40 and 41 respectively along each side wall. Thus, when the trays are cross-nested the product retention fingers penetrate the through passages in the bottom of the trays. FIGS. 3 and 23 show top views of the bottoms of the trays of the second and third embodiments respectively. The trays of the second embodiment are constructed with reduced size end and side walls than the trays of the third embodiment. Accordingly, it is preferred that in the use of a system of trays constructed according to the present invention, a first series of trays, for example constructed according to the second embodiment of the invention, would not be cross-nestable with a second series of trays, for example constructed according to the third embodiment of the present invention. Accordingly, the product retention fingers 40 of the first series and 41 of the second series have a different pattern or spacing relative to one another and between the side walls of the respective trays. Corresponding to this pattern is formed a matching pattern of elongated slots 42 and 43 as shown in FIGS. 3 and 23.

When the trays within the first series are cross-nested with one another, the product retention fingers 41 penetrate the pattern of elongated slots 42 to allow the upper cross-nested tray to rest flat along the bottom tray, or with the bottom surfaces of the upper and lower trays substantially parallel. The same is true, of course, for the trays of the second series in that the product retention fingers 41 are patterned to project through the pattern of elongated slots 43 thus allowing cross-nested trays within the second series to form a cross-nested stack with the bottoms of adjacent trays being supported in substantially parallel relationship with one another.

In order to prevent cross-nesting between trays of a first series and trays of a second series, the pattern of product retention fingers along the side walls of a first series of trays and corresponding elongated slots in the grid structure of the bottom of the first series of trays is different from that of the second series of trays. Accordingly, when a tray of a first series, for example a tray constructed according to the second embodiment, is attempted to be cross-nested onto a tray constructed according to the third embodiment, the product retention fingers along the side wall of the lower tray will penetrate certain ones of the through passages 9' in the bottom of the upper tray, but will not penetrate the elongated slots of the upper tray. As a result of the through passages being provided to extend outwardly only to a dimension that is less than the length between opposing ones of the product retention fingers, one row (side) of product retention fingers will penetrate corresponding ones of the through passages, but the other row (side) of product retention fingers will abut the bottom surface of the upper tray between where the through passages terminate and the end wall begins. Accordingly, cross-nesting of trays of one series with another series will result in the upper tray remaining in a canted position wherein the bottoms of the upper and lower trays are not parallel to one another. As a result, the mixing of one series of trays with another during cross-nesting will be readily apparent and the further cross-nesting of trays onto the canted stack of trays of different series will be prevented.

While preferred embodiments have been described in detail, with the first embodiment including a set of different size trays, for the purpose of providing the best mode and for detailing specific advantageous features, further modifications, embodiments, and variations are contemplated all within the spirit and scope of the present invention as defined by the following claims.

We claim:

1. In a unitary molded plastic bakery tray having a rectangular bottom, a pair of opposed side walls, a pair of opposed and walls, said side walls and end walls being alternately connected to each other and to said bottom around the perimeter of said bottom to provide an upwardly opening rectangular tray, and interengaging means along said end walls for providing first and second different vertical stacking positions of like trays in a like orientation and 180 degree rotated orientation, respectively, for holding therebetween bakery products of corresponding height during storage and transportation, wherein the improvement relating to facilitating blind stacking, comprises:

guide feet at the opposite ends of each of said end walls adjacent said bottom, and outwardly spaced from and separate from said interengaging means, each of said guide feet having a flat downwardly facing first portion;

stacking rail means along each of said end walls spaced outwardly from and separate from said interengaging means, said stacking rail means having recesses at its opposite ends vertically aligned with said guide feet respectively for freely receiving therein said guide feet to a nesting depth of like trays sufficiently for said interengaging means to provide each of said first and second stacking positions;

each said stacking rail means having a flat upwardly facing second portion extending along an entire length of said stacking rail means constructed to receive and support thereon said first portions of said guide feet of an upper said tray to maintain like orientation or 180 degree orientation of like trays vertically spaced at a height greater than said first and second stacking positions, so that when blind stacking said trays, said guide feet of an upper said tray engage said stacking rail means of a lower said tray slidably along the entire length of said stacking rail means to maintain said interengaging means spaced from each other and inoperative until said guide feet align with said interengage with said recesses;

each said stacking rail means further having an inwardly facing third portion extending downwardly from said second portion and extending along the entire length of said stacking rail means; and outwardly facing means adjacent each of said guide feet and spaced downwardly from said first portion of said guide feet of an upper said tray for engaging said third portion of said stacking rail means of a lower said tray to resist lateral movement between upper and lower ones of said trays during blind stacking.

2. The tray according to claim 1, wherein each of said guide feet of an upper said tray and a respective one of said stacking rail means of a lower said tray engage during blind stacking in both the like orientation and 180 degree orientation throughout the full length of said stacking rail means for maintaining said interengaging means inoperatively spaced apart.

3. The tray according to claim 2, wherein said bottom and said side walls are constructed to provide linear sliding means between upper and lower said trays slidably engaging continuously during blind stacking to support the near portions of like trays while the far portions of like trays are supported with respect to each other by the engagement of said guide feet and said stacking rail means.

4. The tray according to claim 2, wherein said bottom has a grid of vertically extending ribs forming therebetween a plurality of at least similar small through passages for aerating and lightness of the tray;

said side walls, said end walls and said ribs all extending downwardly to terminal edges that are coplanar to form a generally parallel horizontal bottom surface interrupted substantially only by said through passages and presenting the lowermost structure of the tray, to constitute tray support means for providing effectively a planar surface;

said pair of end walls each being higher than each of said side walls, and the exterior distance between said pair of side walls being substantially smaller than the interior distance between said end walls, so that said trays may be cross-nested in low level stacking by having alternate trays in the vertical stack rotated about a vertical axis 90 degrees with respect to each other;

each of said side walls having buttress portions extending from opposite ends of said side walls upwardly and outwardly toward said higher end walls at a spacing wider than the distance between said side walls, said buttress portion having top planar surfaces for engaging the planar bottom surface of a like upper tray at the near side engagement during blind stacking of like oriented and 180 degree oriented trays.

5. The tray according to claim 1 further comprising:

said outwardly facing means adjacent said guide feet being support feet adjacent said guide feet and spaced inwardly thereof.

6. The tray according to claim 1, further comprising:

each said stacking rail means including a guide rail, a stacking rail, and a channel having channel walls formed between said rails, wherein one of said channel walls is said inwardly facing third portion of said stacking rail means; and respective ones of said support feet extending into corresponding ones of said channels between said rails during blind stacking for preventing relative lateral movement between upper and lower ones of said trays.

7. The tray according to claim 1, wherein said upwardly facing second portion is an upper flat edge of each of said end walls.

8. The tray according to claim 7, wherein said upwardly facing second portion of said stacking rail means and said downwardly facing first portion of each of said guide feet are parallel to said bottom of said tray.

9. The tray according to claim 8, wherein said inwardly facing third portion of stacking rail means is perpendicular to said upwardly facing second portion of said stacking rail means.

10. The tray according to claim 1, further comprising:

said outwardly facing means adjacent said guide feet being support feet adjacent the guide feet, extending downwardly therefrom and spaced inwardly thereof, said support feet along one end wall being adjacent and on one side of said guide feet, and said support feet on said other end wall being adjacent and on another side of said guide feet; and each said stacking rail means having pockets of two depths for receiving therein predetermined ones of said support feet in 180 degree and like orientation to provide said first and second different vertical stacking positions respectively.

11. The tray according to claim 10, further comprising:

each of said stacking rail means further including a guide rail, a stacking rail and a channel having channel walls formed between said rails, wherein one of said channel walls is said inwardly facing third portion of said stacking rail means; and said support feet extending into said channels respectively between said rails during blind stacking for preventing lateral movement of an upper said tray in relation to a lower said tray.

12. The tray according to claim 11, wherein each of said support feet has a terminal edge what extends a predetermined distance into a corresponding one of said channels respectively during blind stacking such that the terminal edges of said support feet do not contact the respective channel bottoms whereby decreased frictional sliding resistance is maintained.

13. The tray according to claim 3, wherein said linear sliding means includes said side walls having a top edge portion adjacent said end walls and said bottom being recessed upwardly with respect to said corners to form a sloped bottom wall adjacent said corners joining said recessed bottom and said corners at a position spaced inwardly of said guide feet for engaging said top edge portions of said side walls to raise the trailing edge of an upper tray during blind stacking of an upper tray on a lower tray permitting said guide feet to slide into a corresponding one of said recesses.

14. In a unitary molded plastic bakery tray having a rectangular bottom wall, a pair of opposed side walls, a pair of opposed end walls, said side walls and end walls being alternately connected to each other and to said bottom around the perimeter of said bottom to provide an upwardly opening rectangular tray, interengaging means providing high and low different vertical stacked positions in a like orientation and 180 degree orientation of like trays, respectively for holding therebetween bakery products of corresponding height during storage and transport of bakery products, wherein the improvement comprises:

said interengaging means including a top edge stacking rail, a parallel guide rail and an engaging surface between said rails along each of said end walls, a pattern of at least two small recesses and at least two large recesses extending downwardly in each of said guide rails, with the pattern of recesses in one guide rail being different from the pattern of recesses in the other guide rail, so that with 180 degree oriented like stacked trays, vertically adjacent small recesses of adjacent trays will be misaligned vertically of adjacent trays and vertically adjacent large recesses of adjacent trays will be misaligned vertically;

a pattern of at least two large feet and at least two small feet along the bottom of each of said end walls, the pattern of feet on end wall being different from the other end wall, so that with 180 degree oriented like stacked trays, vertically adjacent large feet will be vertically misaligned and vertically adjacent small feet will be vertically misaligned with at least some of said feet engaging said engaging surface to provide the high stacked position;

in the like oriented position of two stacked trays, the large feet of the upper tray being received within the large recesses of the lower tray and the small feet of the upper tray being received within the small recesses of the lower tray to provide the low stacked position;

blind stacking means for providing continuous linear sliding engagement between upper and lower trays for both like orientation and 180 degree orientation, said blind stacking means including said large feet being coplanar with and outward in the sliding direction of said small feet and said large recesses being coplanar with and outward in the sliding direction of said small recesses, said guide rail having uninterrupted linear surfaces between said recesses, said large feet having a bottom continuous linear sliding engagement surface of greater length in the sliding direction than the distance between said linear surfaces on either side of said small recesses to smoothly span said small recesses, and said pair of large feet being closely adjacent said side walls and said pair of large recesses being closely adjacent said side walls; and said blind stacking means thereby providing continuous uninterrupted sliding engagement between the forwardmost large feet on opposite end walls of an upper tray with said engaging surface of a lower tray from an engaging position of said forwardmost one of said large feet of the upper tray slightly beyond vertical alignment with the rearmost one of said large recesses all of the way to the vertically aligned position of said trays for both the like orientation and the 180 degree orientation.

15. The tray according to claim 14, wherein there are only two of said large recesses, two of said small recess two of said large feet and two of said small feet on each of said end walls.

16. The tray according to claim 15, wherein the bottom surface of each of said large and small feet is downwardly channel shaped for receiving within said channel shape the guide rail of the lower of two stacked trays during blind stacking.

17. The tray according to claim 14, wherein the bottom surface of each of said large and small feet is downwardly channel shaped for receiving within said channel shape the guide rail of the lower of two stacked trays during the blind stacking.

18. A tray according to claim 14, wherein said small recesses have vertically sloped surfaces extending outwardly toward said side walls such that if a leading edge of an upper tray being blind stacked onto a lower tray engages one of said small recesses, said sloped surface guides said leading edge upwardly out of said small recess to continue the sliding movement between the trays during blind stacking.

19. A system of trays having at least first and second series of trays wherein each of said trays of each of said series is of unitary molded plastic construction for storing and transporting bakery goods and the like, has a generally rectangular bottom, a pair of opposed end walls and a pair of opposed side walls, with the walls serially connected together around the perimeter of the bottom, the bottom having a grid of vertically extending ribs forming between them a plurality of through passages, wherein the improvement comprises:

said trays of each of said series being stackable in one orientation of trays and each of said trays of said first series and said second series being cross nestable only with others of said trays of the same series;

each of said trays of said first and second series having a plurality of product retention fingers extending upwardly from said side walls above the bottom of the tray;

said first series of trays having said plurality of product retention fingers being positioned with respect to one another and the end walls according to a first predetermined pattern, and said second series of trays having said product retention fingers positioned in relation to one another and between said end walls according to a second predetermined pattern;

said bottom of said first series of trays having a plurality of slot means located along each of said end walls in the bottom of the tray for receiving said product retention fingers of said first pattern when said trays of said first series and cross-nested in stacked relation on one another; and said second series of trays each having a plurality of second slot means along the opposite end walls in the bottom of the tray for receiving said product retention fingers of said second predetermined pattern when trays of said second series are cross-nested in stacked relation on one another, whereby trays of said first series of trays having said first predetermined pattern of product retention fingers are not in alignment with said second slot means and vice versa such that cross-nesting between said first and second series of trays is prevented.

20. The system of trays according to claim 19, wherein said first and second slot means each comprise a plurality of elongated slots extending through said bottom of each of said trays for allowing said product retention fingers of each of said series of trays respectively to extend through said tray bottoms.

21. In a unitary molded plastic bakery tray having a rectangular bottom, a pair of opposed side walls, a pair of opposed end walls, said side walls and end walls being alternately connected to each other and to said bottom around the perimeter of said bottom to provide an upwardly opening rectangular tray, and interengaging means along said end walls for providing first and second different vertical stacking positions of like trays in a like orientation and 180 degree rotated orientation, respectively, for holding therebetween bakery products of corresponding height during storage and transportation, wherein the improvement relating to facilitating blind stacking, comprises:

guide feet at the opposite ends of each of said end walls adjacent said bottom, and outwardly spaced from and separate from said interengaging means, each of said guide feet having a flat downwardly facing portion;

stacking rail means along each of said end walls, each having recesses at its opposite ends vertically aligned with said guide feet respectively for freely receiving therein said guide feet to a nesting depth of like trays sufficiently for said interengaging means to provide each of said first and second stacking positions; and each said stacking rail means having a flat upwardly facing portion extending along its entire length constructed to receive and support thereon said flat downwardly facing portions of corresponding ones to said guide feet to maintain like orientation or 180 degree orientation of like trays vertically spaced at a height greater than said first and second stacking positions, so that when blind stacking said trays, said guide feet of an upper said tray engage said stacking rail means of a lower said tray slidably along their entire length to maintain said interengaging means spaced from each other and inoperative until said guide feet align with and interengage with said recesses;

each of said end walls having guide rail means parallel to and adjacent a respective one of said stacking rail means, and a channel having channel walls formed between said rail means, herein each of said stacking rail means and said guide rail means along each said end wall has a facing wall portion defining one of said walls of said channels; and first support feet along each of said end walls extending into corresponding ones of said channels between said channel walls when said guide feet engage said stacking rail means for providing lateral guidance between upper and lower ones of said trays during blind stacking.

22. The tray according to claim 21, wherein said support feet are adjacent said guide feet and each of said support feet has a terminal edge that extends a predetermined distance into a corresponding one of said channels respectively during blind stacking such that the terminal edges of said support feet do not contact the respective channel bottoms.

23. The tray according to claim 21, wherein each of said channels has first and second depth pockets adjacent each of said recesses for receiving therein said first support feet in like and 180 degree orientation of an upper one of said trays for providing each of said vertical stacking positions respectively.

24. The tray according to claim 21, further comprising:

each of said end walls having second support feet spaced inside of said first support feet; and each of said channels has third depth pockets for receiving therein said second support feet in like orientation of upper and lower ones of said trays in one of said vertical stacking positions; and in the other of said vertical stacking positions; said second support feet engaging said being supported by a bottom of said channels in 180 degree orientation of upper and lower ones of said trays.

* * * * *